US009194140B2

(12) United States Patent
Hemphill

(10) Patent No.: US 9,194,140 B2
(45) Date of Patent: Nov. 24, 2015

(54) METHOD AND APPARATUS FOR REPAIRING CONCRETE

(75) Inventor: William Scott Hemphill, Wilmington (DE)

(73) Assignee: Garland Industries, Inc., Cleveland, OH (US)

( * ) Notice: Subject to any disclaimer, the term of this patent is extended or adjusted under 35 U.S.C. 154(b) by 877 days.

(21) Appl. No.: 12/939,418

(22) Filed: Nov. 4, 2010

(65) Prior Publication Data

US 2012/0110940 A1 May 10, 2012

(51) Int. Cl.
*E04G 23/02* (2006.01)
*E04C 5/07* (2006.01)
*E04C 5/16* (2006.01)

(52) U.S. Cl.
CPC ..... *E04G 23/0218* (2013.01); *E04C 5/073* (2013.01); *E04C 5/16* (2013.01)

(58) Field of Classification Search
CPC ..... E04G 23/0218; E04G 23/02; B29C 70/08; E04C 5/07; E04C 5/16
USPC ..... 52/514, 514.5, 698, 713, 746.1; 156/71, 156/94, 293
See application file for complete search history.

(56) References Cited

U.S. PATENT DOCUMENTS 1,223,045 A 4/1917 Ferguson
4,935,301 A 6/1990 Rerup et al.
5,063,006 A * 11/1991 Tahara ..... 264/35
5,185,013 A * 2/1993 Martin ..... 52/514
5,476,340 A 12/1995 Contrasto
5,513,925 A 5/1996 Dempsey et al.
5,649,398 A * 7/1997 Isley et al. ..... 52/309.17
5,763,043 A 6/1998 Porter
6,052,964 A 4/2000 Ferm
6,183,835 B1 2/2001 Cho
6,263,629 B1 7/2001 Brown, Jr. et al.
6,312,541 B1 11/2001 Hemphill
6,330,776 B1 12/2001 Jinno et al.
6,389,775 B1 5/2002 Steiner et al.
6,405,508 B1 * 6/2002 Janesky ..... 52/741.4
6,416,693 B1 7/2002 Lockwood
6,532,714 B1 3/2003 Ferm
6,851,232 B1 * 2/2005 Schwegler ..... 52/223.8
7,207,149 B2 4/2007 Fyfe et al.
RE39,839 E 9/2007 Wheatley
7,311,964 B2 12/2007 Aldea
7,574,840 B1 * 8/2009 Fyfe ..... 52/582.1
7,736,088 B2 6/2010 Boxall
7,743,585 B2 * 6/2010 Wheatley ..... 52/746.1
7,823,354 B2 * 11/2010 Wheatley ..... 52/506.01
7,946,088 B1 * 5/2011 Fyfe et al. ..... 52/344
8,087,210 B2 1/2012 Agneloni
2001/0047844 A1 12/2001 Edwards
2001/0049399 A1 12/2001 Edwards
2004/0200173 A1 * 10/2004 Drake ..... 52/514.5
2005/0241260 A1 * 11/2005 Wheatley ..... 52/719
2006/0162845 A1 7/2006 Bogard

OTHER PUBLICATIONS

Recent developments in the use of FRP anchors and masonry wall strengthening techniques; Alan C. Burr, The Structural Engineer, Sep. 21, 2004, pp. 20-21.

(Continued)

*Primary Examiner* — Adriana Figueroa
*Assistant Examiner* — Jessie Fonseca
(74) *Attorney, Agent, or Firm* — Fay Sharpe LLP

(57) ABSTRACT

An improved anchor for securing a reinforcement strip to a concrete structure.

26 Claims, 11 Drawing Sheets

(56) References Cited

OTHER PUBLICATIONS

Behaviour of Handmade FRP anchors under tensile load in uncracked concrete; S.J. Kim & S.T. Smith, Advances in Structural Engineering, vol. 12, No. 6, 2009, pp. 845-865.

Experimental behavior of carbon fiber-reinforced polymer (CFRP) sheets attached to concrete surfaces using CRFP anchors; Carl W. Niemitz, et al.; Jour. of Composites for Construction; 2010; pp. 185-194.

Mechanical properties of CFRP anchorages, Thesis, Middle East Technical Univ. Gokhan Ozdemir; Jan. 2005.

* cited by examiner

METHOD AND APPARATUS FOR REPAIRING CONCRETE

The present invention is directed to a method and apparatus for strengthening concrete, more particularly directed to a method and apparatus for reinforcing a concrete structure, and more particularly directed to a method and apparatus for a connector used in reinforcing a concrete structure.

BACKGROUND OF THE INVENTION

Concrete is a common material for use in the construction of larger buildings because the concrete is relatively inexpensive and has good compressive strength. Buildings such as multilevel apartment buildings, office buildings and the like are designed to support their own weight plus that of expected inhabitants and furnishings. Concrete materials have excellent vertical compression properties, thus are used in such structures.

Many different techniques have been used to reinforce concrete. One common method for reinforcing concrete includes the use of a reinforcing sheet made of reinforcing fibers, such as carbon fibers, aramid fibers, glass fibers, or the like, that are attached on the surface of a concrete surface. The reinforcing sheet is arranged and attached along an outer surface of the concrete surface to reinforce the concrete against bending stresses applied thereto. The reinforcing sheet is generally attached to the concrete by an adhesive. However, when the reinforcing sheet is merely adhesively attached to the concrete, the edges of the reinforcing sheet or the entire reinforced sheet can become delaminated or debonded from the concrete. As such, the edges of the reinforcing sheet are typically joined to the concrete by use of an anchor that is hammered and joined into the concrete. However, hammering the anchor to join the edges of the reinforcing sheet requires a great deal of time and the anchors or the fitting members generally protrude from the surface of the concrete which is aesthetically displeasing and/or creates other problems such as when facing panels are to be connected to the concrete.

Another prior art method for reinforcing concrete is to secure a reinforcing sheet to the concrete by forming holes in the concrete and passing the reinforcing sheet through the holes and subsequently filling the holes with a resin material, a mortar, or the like. This method can be very time consuming and labor intensive. Also, the drilling of holes through the concrete can result in damage to the concrete.

Another prior art method to reinforce concrete is by coating the concrete surface and attaching a steel plate to the coated concrete surface. However, steel plates are heavy and difficult to install. The weight of the steel plate can also create weight issues in the building. Also, the reinforced concrete becomes substantially thicker as compared to the original structure when steel plates are attached to the concrete, thereby reducing room space.

Two prior art methods have been developed to overcome these past problems associated with reinforcing concrete and are disclosed in U.S. Pat. No. 6,330,776 and U.S. Pat. No. 7,574,840, both of which are fully incorporated herein by reference. The '776 patent discloses the use of an anchor that is formed of a plurality of reinforcing fibers such as carbon fibers, aramid fibers, glass fibers, and the like. A portion of the anchor is bundled in the longitudinal direction and inserted into a hole in a concrete structure, and the remaining portion of the anchor that is not bundled, is spread or splayed on the surface of the concrete structure. This type of anchor is known as a Splay anchor. A reinforcing member in the form of a plate or sheet is thereafter connected to the surface of the concrete structure and to the portion of the anchor spread or splayed on the surface of the concrete structure. A bonding material is inserted into the hole containing the bundled portion of the anchor so as to secure the anchor in the hole in the concrete structure. A bonding agent is also used to secure the reinforcing member of the portion of the anchor spread or splayed on the surface of the concrete structure.

The '840 patent also discloses the use of an anchor that is formed of a plurality of reinforcing fibers such as carbon fibers, aramid fibers, glass fibers, and the like. The '840 patent discloses that the middle portion of the anchor is bundled and is designed to be inserted into a hole in a concrete structure and the remaining portion of the two ends of the anchor that is not bundled, is spread or splayed on the surface of the concrete structure or another concrete structure. A bonding material is inserted into the hole containing the bundled portion of the anchor so as to secure the anchor in the hole in the concrete structure. A bonding agent is also used to secure the portion of the anchor spread or splayed on the surface of the concrete structure, and to secure a reinforcing member on the concrete structure and to the anchor.

The purpose of the anchors disclosed in the '776 patent and the '840 patent is to ensure that the reinforcement strip used to reinforce the concrete reaches its maximum capacity. As such, the problem the anchors are meant to deal with is to maintain the reinforcement strip and concrete structure together long enough such that the reinforcement strip can reach its maximum capacity. The bond between the reinforcement strip and the concrete surface is much weaker than the strength of the reinforcement strip. When a concrete beam or column begins to bend, such bending only accelerates the debonding of the reinforcement strip from the concrete surface, thus resulting in the reinforcement strip peeling off of the concrete surface. The anchors are not designed to prevent the reinforcement strip from debonding from the concrete. Additional prior art anchors are disclosed in U.S. Pat. No. 6,389,775 and U.S. Pat. No. 7,207,149, and, Burr, Alan C. "Recent Developments in the Use of FRP Anchors and Masonry Wall Strengthening Techniques." *The Structural Engineer* (2004): 20-21; Kim, S. J., and S. T. Smith. "Behavior of Handmade FRP Anchors under Tensile Load in Uncracked Concrete." *Advances in Structural Engineering* 12.6 (2009): 845-65; Niemitz, Carl W., Ryan James, and Sergio F. Breno. "Experimental Behavior of Carbon Fiber-Reinforced Polymer, CFRP . . . Sheets Attached to Concrete Surfaces Using CFRP Anchors." *Journal of Composites for Construction* 14.2 (2010): 185-94; Özdemir, Gökhan, and :. Akyüz, Uğurhan. Supervisor. *Mechanical Properties of CFRP Anchorages*. Thesis. Middle East Technical University, 2005, Pham, Le Tuan. *Development of a Quality Control Test for Carbon Fiber Reinforced Polymer Anchors*. Thesis. University of Texas at Austin, 2009, all of which are fully incorporated herein by reference.

Although the prior art methods for reinforcing concrete disclosed in the '776 patent and the '840 patent are effective in strengthening the concrete, the anchors fail long before the reinforcement strip can reach its maximum capacity. As such, there remains a continued need to simplify the reinforcing installation process and to improve the strength of the reinforced concrete.

SUMMARY OF THE INVENTION

The present invention is directed to a method and apparatus for strengthening concrete structures, and more particularly directed to a method and apparatus for strengthening and reinforcing preexisting concrete structures. The method for strengthening and reinforcing preexisting concrete structures of the present invention includes the use of a novel composite material that is used to faun an anchor for a reinforcement strip for use with a concrete structure. A portion of the anchor is designed to be connected to the reinforcement strip. The method for strengthening and reinforcing preexisting concrete structures of the present invention is simple to implement, generally less expensive than preexisting anchoring systems, and results in a stronger anchoring system than past anchoring systems.

In one non-limiting aspect of the present invention, the novel anchor is a composite material that includes a fiber component that is at least partially incorporated in an adhesive such as an anchor resin material. In one non-limiting embodiment of the invention, the fiber component includes one or more types of fibers (e.g., carbon fibers, glass fibers aramid fibers [Kevlar, Twaron, etc.], boron fibers, hemp, basalt fibers, etc.). The fiber component can include one or more layers of fibers. Each layer of the fiber component can be formed of woven or non-woven fibers. In one non-limiting embodiment of the invention, the fiber component includes one or more layers of fiber having an average tensile strength of at least about 40 KSI. The tensile strength is the maximum stress that the fiber can withstand before failure of the fiber. In one non-limiting aspect of this embodiment, the one or more layers of fiber have a tensile strength about 50-700 KSI. In another and/or alternative non-limiting aspect of this embodiment, the one or more layers of fibers have a tensile strength of about 50-675 KSI. In still another and/or alternative non-limiting aspect of this embodiment, the one or more layers of fiber have a tensile strength of about 60-660 KSI. In another and/or alternative non-limiting embodiment of the invention, the fiber component includes one or more fabric layers. Each of the fabric layers includes two or more layers of fibers oriented in a nonparallel relationship to one another. The two or more layers of fibers that form each of the fabric layers are generally bonded and/or woven together; however, the fibers of the fabric layers can be connected together by other or additional means (e.g., heat bonding, adhesive, etc.). In one non-limiting arrangement, the two or more layers of fibers that form the one or more of the fabric layers in the fiber component are stitched together, heat bonded together and/or adhesively connected together. In another and/or alternative non-limiting arrangement, the two or more layers of fibers that form the one or more of the fabric layers in the fiber component can be formed of the same or different fiber material. In still another and/or alternative non-limiting arrangement, at least one fabric layer in the fiber component is formed of two to four fiber layers, and the adjacently positioned fiber layers are oriented in a nonparallel relationship to one another. The volume of fibers used for each fiber layer in the one or more fabric layers used in the fiber component can be the same or different. In one non-limiting design, the fiber component includes at least two fabric layers, and at least one of the fabric layers is formed of two to four fiber layers that are stitched and/or woven together, and wherein each fiber layer is formed of the same material and each fiber layer has the same volume and same number of fibers. In another and/or alternative non-limiting design, the fiber component includes two fabric layers, and at least one of the fabric layers is formed of two to four fiber layers that are stitched and/or woven together, and wherein each fiber layer is formed of carbon fibers or glass fibers, each fiber layer has the same volume and same number of fibers, and the adjacently positioned fiber layers are oriented at a nonparallel relationship to one another. In still another and/or alternative non-limiting design, the fiber component includes two fabric layers that are formed of fiber layers that are stitched and/or woven together, and wherein each fiber layer is formed of carbon fibers or glass fibers, each fiber layer has the same volume and same number of fibers, and the adjacently positioned fiber layers are oriented at a nonparallel relationship to one another (bi-axial configuration). In another and/or alternative non-limiting design, the fiber component includes two fabric layers that are formed of fiber layers that are stitched and/or woven together, and wherein each fiber layer is formed of carbon fibers or glass fibers, each fiber layer has the same volume and same number of fibers, and the adjacently positioned fiber layers are oriented at a nonparallel relationship to one another (tri-axial configuration). In yet another and/or alternative non-limiting design, the fiber component includes two fabric layers that have a similar size and shape and are generally symmetrically oriented together with one another. In still yet another and/or alternative non-limiting design, the fabric layers of the fiber components can be connected together by stitching, adhesive, mechanical connection (e.g., clamp, staple, etc.) and/or melt bonding. In another and/or alternative non-limiting design, a portion of one or more fabric layers of the fabric component can be coated with the anchor resin material and then pressed together until the anchor resin material cures. A vacuum can optionally be applied during the pressing and curing steps. In still another and/or alternative non-limiting design, the process for forming the anchor can be by a batch process or a continuous process. In yet another and/or alternative non-limiting design, the anchor resin material can be pre-applied and/or applied as a portion of the fabric layers of the fiber component are brought together.

In another and/or alternative non-limiting aspect of the present invention, the novel anchor is preformed prior to be secured to a concrete structure and the preformed anchor includes a fiber component that includes a plurality of fibers only partially secured together by the anchor resin material. In one non-limiting embodiment of the invention, the anchor resin material generally includes vinyl ester resins, epoxy resins, polyester resins and/or phenolic resins. In one non-limiting formulation, the anchor resin material includes a vinyl ester resin. In one non-limiting embodiment of the invention, less than about 95% of the longitudinal length of the fabric component is connected together by the anchor resin material prior to the anchor being connected to a concrete structure. The fabric component has a bottom portion and top portion. The bottom portion of the anchor is defined as the portion of the anchor that is designed to be partially or fully positioned in a slot or opening in a concrete structure. The top portion of the anchor is defined as the portion of the anchor that is designed to not be positioned in or mostly not positioned in a slot or opening in a concrete structure. All or a majority of the top portion of the anchor is designed to be positioned on or overlie the surface of a concrete structure and/or be secured to the reinforcement strip. Generally, about 50%-100% of the bottom portion of the fabric component is connected together by the anchor resin material. Generally, about 0-99% of the top portion of the fabric component is connected together by the anchor resin material. Generally, the anchor resin material is fully or partially cured on the anchor prior to the anchor being secured to the concrete structure. Generally, the anchor resin material is more than 50% cured, typically more than 70% cured, more typically more than 80% cure, still more typically more than 90% cured, yet more typically more than 90% cured, and still yet more typically about 100% cured prior to the bottom portion contacting a material used to secure the bottom portion of the anchor in the opening or slot of the concrete structure, and/or prior to the top portion contacting a material used to secure the top portion of the anchor to the reinforcement strip and/or outer surface of the concrete structure. Generally, the anchor resin material is not the resin and/or other type of adhesive used to secure the bottom portion of the anchor in the opening or slot of the concrete structure; however this is not required. Likewise, the anchor resin material is generally not the resin and/or other type of adhesive used to secure the top portion of the anchor to the reinforcement strip and/or outer surface of the concrete structure; however, this is not required. As can be appreciated, the partially or fully cured anchor resin material used to bond together the fiber component of the bottom portion of the anchor can also subsequently be used to secure the bottom portion of the anchor in the opening or slot of the concrete structure, and/or secure the top portion of the anchor to the reinforcement strip and/or outer surface of the concrete structure; however, this is not required. In one non-limiting design, about 60%-100% of the bottom portion is connected together by the anchor resin material. In another and/or alternative non-limiting design, about 70%-100% of the bottom portion is connected together by the anchor resin material. In still another and/or alternative non-limiting design, about 75%-100% of the bottom portion is connected together by the anchor resin material. In yet another and/or alternative non-limiting design, about 80%-100% of the bottom portion is connected together by the anchor resin material. In still yet another and/or alternative non-limiting design, about 90%-100% of the bottom portion is connected together by the anchor resin material. In another and/or alternative non-limiting design, about 95%-100% of the bottom portion is connected together by the anchor resin material. In still another and/or alternative non-limiting design, about 99%-100% of the bottom portion is connected together by the anchor resin material. In yet another and/or alternative non-limiting design, up to about 80% of the top portion is connected together by the anchor resin material. In still yet another and/or alternative non-limiting design, up to about 60% of the top portion is connected together by the anchor resin material. In another and/or alternative non-limiting design, up to about 50% of the top portion is connected together by the anchor resin material. In yet another and/or alternative non-limiting design, up to about 40% of the top portion is connected together by the anchor resin material. In still yet another and/or alternative non-limiting design, up to about 25% of the top portion is connected together by the anchor resin material. In another and/or alternative non-limiting design, up to about 15% of the top portion is connected together by the anchor resin material. In still another and/or alternative non-limiting design, up to about 10% of the top portion is connected together by the anchor resin material. In another and/or alternative non-limiting design, up to about 5% of the top portion is connected together by the anchor resin material. In yet another and/or alternative non-limiting design, none of the top portion is connected together by the anchor resin material. In one non-limiting design, about 80-100% of the bottom portion of the anchor is connected together by the anchor resin material, and about 0-20% of the top portion of the anchor is connected together by the anchor resin material. In another and/or alternative non-limiting design, about 90-100% of the bottom portion of the anchor is connected together by the anchor resin material, and about 0-10% of the top portion of the anchor is connected together by the anchor resin material. In still another and/or alternative non-limiting design, about 95-100% of the bottom portion of the anchor is connected together by the anchor resin material, and about 0-5% of the top portion of the anchor is connected together by the anchor resin material.

In still another and/or alternative non-limiting aspect of the present invention, the novel anchor is formed of two or more fabric layers that are at least partially connected together at the bottom portion of the anchor by the anchor resin material. Generally, the top portion of at least two of the fabric layers is not fully connected together by any arrangement so as to enable the top portions of such fabric layers to be separated from one another. As will be explained in more detail below, the bonded together bottom portions of the fabric layers are designed to be inserted into a hole or slot in a concrete structure and then bonded in such hole or slot, and the non-bonded top portions of the fabric layers are designed to be laid over and bonded to an outer surface of the concrete structure and/or bonded to the reinforcement strip. The resin bonded portion of the anchor (e.g., bottom portion) is generally a much more rigid and less flexible portion of the anchor than the non-resin bonded portion of the anchor. Such an arrangement is intended so that the rigid portion of the anchor can easily be placed into the hole or slot in the concrete structure and the less rigid portion can be bent and laid onto and/or over the outer surface of the concrete structure while the rigid portion is positioned in the hole or slot of the concrete structure. In one non-limiting aspect of this embodiment, less than about 90% of the longitudinal length of at least two fabric layers is connected together by the anchor resin material. In another and/or alternative non-limiting aspect of this embodiment, less than about 80% of the longitudinal length of at least two fabric layers is connected together by the anchor resin material. In still another and/or alternative non-limiting aspect of this embodiment, about 2-75% of the longitudinal length of at least two fabric layers is connected together by the anchor resin material. In yet another and/or alternative non-limiting aspect of this embodiment, about 5-60% of the longitudinal length of at least two fabric layers is connected together by the anchor resin material. In still yet another and/or alternative non-limiting aspect of this embodiment, about 5-50% of the longitudinal length of at least two fabric layers is connected together by the anchor resin material. In another and/or alternative non-limiting aspect of this embodiment, about 5-49% of the longitudinal length of at least two fabric layers is connected together by the anchor resin material. In still another and/or alternative non-limiting aspect of this embodiment, about 5-40% of the longitudinal length of at least two fabric layers is connected together by the anchor resin material. In yet another and/or alternative non-limiting aspect of this embodiment, about 5-30% of the longitudinal length of at least two fabric layers is connected together by the anchor resin material. In still yet another and/or alternative non-limiting aspect of this embodiment, about 5-25% of the longitudinal length of at least two fabric layers is connected together by the anchor resin material. In one non-limiting configuration, the novel anchor includes at least two fabric layers that include carbon and/or glass fibers, and which the bottom portions of the two fabric layers are connected together by a resin material, and which the top portions of the two fabric layers are only partially connected together or not connected together by a resin material, and which about 5-60% of the longitudinal length of the at least two fabric layers are connected together by the resin material. In still another and/or alternative non-limiting embodiment of the invention, only one side of the fabric layers that form the bottom portion of the anchor are fully coated and/or impregnated with the anchor resin material. The fabric material typically includes a first and second side. In one non-limiting configuration, the anchor resin material is coated onto and/or impregnated into the first side of one or both of the fabric materials and then the first side of two layers of fabric material are brought together so that the anchor resin material bonds together the first sides of the two layers of fabric material to form all or part of the bottom portion of the anchor. In such an arrangement, the second side of the fabric layers generally includes little, if any anchor resin material. As such, the second side of the fabric layers that form all, or a portion of the bottom portion of the anchor and/or the outer surface of the bottom portion of the anchor retains its porous properties so that such second side of the fabric layers and/or outer surface of the bottom portion can form a strong adhesive bond within the slot or hole in the concrete. Generally, the second side of the fabric layers and/or outer surface of the bottom portion retains a textured, non-smooth surface (e.g., rough, wavy, etc.) that can enhance the bond between the concrete and the second side of the fabric layer and/or outer surface of the bottom portion; however, this is not required. As can be appreciated, some of the anchor resin material may seep through the body of the fabric material to the second side of the fabric layers and/or outer surface of the bottom portion when the layers of fabric material are pressed together to bond the first sides of the fabric material with the anchor resin material. As such, in this particular non-limiting arrangement for the anchor, the amount of anchor resin material used to bond the first sides of the fabric layers should be controlled so as to limit such resin seepage to the second side of one or both of the fabric layers and/or outer surface of the bottom portion of the anchor. In one non-limiting arrangement, less than about 90% of the surface of the second side of the fabric material that form all or a portion of the bottom portion of the anchor and/or outer surface of the bottom portion of the anchor includes resin material. In another and/or alternative non-limiting arrangement, less than about 75% of the surface of the second side of the fabric material that forms all or a portion of the bottom portion of the anchor and/or outer surface of the bottom portion of the anchor includes the anchor resin material. In still another and/or alternative non-limiting arrangement, less than about 50% of the surface of the second side of the fabric material that forms all or a portion of the bottom portion of the anchor and/or outer surface of the bottom portion of the anchor includes the anchor resin material. In yet another and/or alternative non-limiting arrangement, less than about 25% of the surface of the second side of the fabric material that forms all or a portion of the bottom portion of the anchor and/or outer surface of the bottom portion of the anchor includes the anchor resin material. In still yet another and/or alternative non-limiting arrangement, less than about 10% of the surface of the second side of the fabric material that forms all or a portion of the bottom portion of the anchor and/or outer surface of the bottom portion of the anchor includes the anchor resin material. In yet another and/or alternative non-limiting embodiment of the invention, the surface of the second side of the fabric material that forms all or a portion of the top portion of the anchor and/or outer surface of the bottom portion of the anchor is porous to a subsequently applied adhesive and/or includes little or no adhesive. This porous and/or non-adhesive top portion of the anchor enables such portion to form a strong bond with the concrete surface and/or reinforcement strip via an adhesive.

In still another and/or alternative non-limiting aspect of the present invention, the novel anchor has a certain size, shape and thickness to achieve the desired anchoring properties for the concrete structure. In one non-limiting embodiment of the invention, the width of the anchor is generally about 5-100% the width of the hole or slot in the concrete structure that the anchor is connected. The width can be constant or non-constant along the longitudinal length of the anchor. In one non-limiting aspect of this embodiment, the width of the anchor is about 10-99% the width of the hole or slot in the concrete structure that the anchor is connected. In still another and/or alternative non-limiting aspect of this embodiment, the width of the anchor is about 25-99% the width of the hole or slot in the concrete structure that the anchor is connected. In yet another and/or alternative non-limiting aspect of this embodiment, the width of the anchor is about 40-99% the width of the hole or slot in the concrete structure that the anchor is connected. In still yet another and/or alternative non-limiting aspect of this embodiment, the width of the anchor is about 60-99% the width of the hole or slot in the concrete structure that the anchor is connected. In another and/or alterative non-limiting embodiment of the invention, the longitudinal length of the anchor is selected to be greater than the depth of the hole or slot in the concrete structure that the bottom portion of the anchor is to be secured. Generally, the longitudinal length of the anchor is at least about 25% greater than the depth of the hole or slot in the concrete structure. In one non-limiting aspect of this embodiment, the longitudinal length of the anchor is at least about 50% greater than the depth of the hole or slot in the concrete structure. In another and/or alternative non-limiting aspect of this embodiment, the longitudinal length of the anchor is about 50%-600% greater than the depth of the hole or slot in the concrete structure. In still another and/or alternative non-limiting aspect of this embodiment, the longitudinal length of the anchor is about 75%-500% greater than the depth of the hole or slot in the concrete structure. In yet another and/or alternative non-limiting aspect of this embodiment, the longitudinal length of the anchor is about 75%-400% greater than the depth of the hole or slot in the concrete structure. In still yet another and/or alternative non-limiting aspect of this embodiment, the longitudinal length of the anchor is about 100%-350% greater than the depth of the hole or slot in the concrete structure. In another and/or alternative non-limiting aspect of this embodiment, the longitudinal length of the anchor is about 200%-350% greater than the depth of the hole or slot in the concrete structure. In still another and/or alterative non-limiting embodiment of the invention, the thickness of the anchor is generally less than about 50% the width of the anchor. The thickness can be constant or non-constant along the longitudinal length of the anchor. In one non-limiting aspect of this embodiment, the thickness of the anchor is less than about 30% the width of the anchor. In another and/or alternative non-limiting aspect of this embodiment, the thickness of the anchor is less than about 25% the width of the anchor. In still another and/or alternative non-limiting aspect of this embodiment, the thickness of the anchor is about 0.1-20% the width of the anchor. In yet another and/or alternative non-limiting aspect of this embodiment, the thickness of the anchor is about 0.2-10% the width of the anchor. In still yet another and/or alternative non-limiting aspect of this embodiment, the thickness of the anchor is about 0.5-5% the width of the anchor. In yet another and/or alternative non-limiting embodiment of the invention, the length ratio of the bottom portion to the top portion of the anchor is about 0.1-5:1. In one non-limiting aspect of this embodiment, the length ratio of the bottom portion to the top portion of the anchor is about 0.1-2:1. In another and/or alternative non-limiting aspect of this embodiment, the length ratio of the bottom portion to the top portion of the anchor is about 0.1-1:1. In still another and/or alternative non-limiting aspect of this embodiment, the length ratio of the bottom portion to the top portion of the anchor is about 0.1-0.9:1. In yet another and/or alternative non-limiting aspect of this embodiment, the length ratio of the bottom portion to the top portion of the anchor is about 0.2-0.75:1. In still yet another and/or alternative non-limiting aspect of this embodiment, the length ratio of the bottom portion to the top portion of the anchor is about 0.2-0.5:1. In another and/or alternative non-limiting aspect of this embodiment, the length ratio of the bottom portion to the top portion of the anchor is about 0.2-0.4:1. In yet another and/or alternative non-limiting embodiment of the invention, the bottom portion of the anchor has a curved bottom edge; however, this is not required. In one non-limiting configuration, the bottom portion has a curved bottom edge such that the bottom portion has a generally half circle shape or hemispherical shape. In still yet another and/or alternative non-limiting embodiment of the invention, the bottom portion has a generally square or rectangular shape; however, this is not required.

In yet another and/or alternative non-limiting aspect of the present invention, the bottom portion of the anchor does not have any cuts or openings. The inclusion, or the forming of one or more cuts or openings in the resin bonded bottom portion of the anchor can reduce the strength of the bottom portion of the anchor. The outer surface of the bottom portion of the anchor can optionally be formed of a second side surface of a fabric layer that includes little or no resin material so as to retain some textured surface that can be used to bond with an adhesive in the cut hole or slot in the concrete structure to thereby secure the bottom portion of the anchor to the concrete structure. However, it can be appreciated that the outer surface of the bottom portion of the anchor can be fully coated with the anchor resin material.

In still yet another and/or alternative non-limiting aspect of the present invention, the amount of fiber and fabric used in the anchor is a function of the load that is desired to be transferred to the anchor and reinforcement strip. Generally, the amount of fiber and fabric in the anchor should be sufficient to have a tensile capacity in excess of the tensile shear strength of the concrete upon which the top portion of the anchor overlies. The tensile strength of the fibers used to form the anchor should be equal to or stronger than the tensile strength of the fibers used in the reinforcement strip. When glass fibers are used in the anchor, the tensile strength of the glass fibers is generally at least about 40-50 KSI. When carbon fibers are used in the anchor, the tensile strength of the carbon fibers is generally at least about 80-90 KSI.

In still yet another and/or alternative non-limiting aspect of the present invention, the composition, thickness, width and length of the reinforcement strip is selected to obtain the desired reinforcement properties for the concrete structure. In one non-limiting embodiment of the invention, the reinforcement strip includes one or more fiber layers. In another and/or alternative non-limiting embodiment of the invention, the reinforcement strip includes one or more fabric layers. The one or more fabric layers, when used in the reinforcement strip, are generally formed in the same or similar way as the one or more fabric layers that can be used in the anchor as discussed above; however, this is not required. In still another and/or alternative non-limiting embodiment of the invention, the composition of the fibers in the one or more fiber layers of the reinforcement strip can include one or more types of fibers (e.g., carbon fibers, glass fibers, aramid fibers [Kevlar, Twaron, etc.], boron fibers, hemp, basalt fibers, etc.). In one non-limiting aspect of this embodiment, the reinforcement strip and the anchor include at least one fiber layer having the same composition; however, this is not required. In another and/or alternative non-limiting aspect of this embodiment, the reinforcement strip and the anchor include at least one fabric layer having the same composition and which is formed in the same manner; however, this is not required. In still another and/or alternative non-limiting aspect of this embodiment, the reinforcement strip is formed of one of more fabric layers that include glass and/or carbon fibers. In yet another and/or alternative non-limiting embodiment of the invention, the ratio of the width of the reinforcement strip to the width of the top portion of the anchor is about 0.25-4:1. The width of the reinforcement strip can be constant or vary along the longitudinal length of the reinforcement strip. In one non-limiting aspect of this embodiment, the ratio of the width of the reinforcement strip to the width of the top portion of the anchor is about 0.4-2.5:1. In another and/or alternative non-limiting aspect of this embodiment, the ratio of the width of the reinforcement strip to the width of the top portion of the anchor is about 0.5-2:1. In still another and/or alternative non-limiting aspect of this embodiment, the ratio of the width of the reinforcement strip to the width of the top portion of the anchor is about 0.75-1.5:1. In yet another and/or alternative non-limiting aspect of this embodiment, the ratio of the width of the reinforcement strip to the width of the top portion of the anchor is about 0.9-1.1:1. When the width of the reinforcement strip is greater than the width of the top portion of the anchor, an additional anchor can be positioned next to another anchor; however, this is not required. In still another and/or alternative non-limiting embodiment of the invention, the thickness and length of the reinforcement strip is generally dependent on the degree of reinforcement required and the particular application the anchor and reinforcement strip is to be used. The thickness of the reinforcement strip can be constant or vary along the longitudinal length of the reinforcement strip. In one non-limiting aspect of the invention, the thickness ratio of the reinforcement strip to the anchor is generally about 0.1-2:1. In another and/or alternative non-limiting aspect of the invention, the thickness ratio of the reinforcement strip to the anchor is generally about 0.1-1:1. In still another and/or alternative non-limiting aspect of the invention, the thickness ratio of the reinforcement strip to the anchor is generally about 0.2-0.9:1. In yet another and/or alternative non-limiting aspect of the invention, the thickness ratio of the reinforcement strip to the anchor is generally about 0.25-0.75:1. In still yet another and/or alternative non-limiting aspect of the invention, the thickness ratio of the reinforcement strip to the anchor is generally about 0.4-0.6:1. In yet another and/or alternative non-limiting embodiment of the invention, the shape of the reinforcement strip is generally square or rectangular; however, this is not required.

In still yet another and/or alternative non-limiting aspect of the present invention, the type of adhesive used to 1) secure the bottom portion of the anchor in a hole or slot in the concrete structure, 2) secure the top portion of the anchor to an outer surface of the concrete structure, 3) secure the reinforcement strip to an outer surface of the concrete structure, and 4) connect together the top portion of the anchor to the reinforcement strip can be the same or different. In one non-limiting embodiment of the invention, the adhesive used to secure the bottom portion of the anchor in a hole or slot in the concrete structure can include vinyl ester resins, epoxy resins, polyester resins and/or phenolic resins. In one non-limiting aspect of this embodiment, the adhesive is an epoxy such as, but not limited to, a two component 100% solids thixotropic epoxy. In another and/or alternative non-limiting aspect of this embodiment, the resin used to bond together the one or more fiber layers and/or one or more fabric layers in the bottom portion of the anchor are different from the adhesive used to secure the bottom portion of the anchor in a hole or slot in the concrete structure. In another and/or alternative non-limiting embodiment of the invention, the adhesive used to secure the top portion of the anchor to an outer surface of the concrete structure can include vinyl ester resins, epoxy resins, polyester resins and/or phenolic resins. In one non-limiting aspect of this embodiment, the adhesive is an epoxy. In another and/or alternative non-limiting aspect of this embodiment, the adhesive used to secure the top portion of the anchor to an outer surface of the concrete structure is different from the adhesive used to secure the bottom portion of the anchor in a hole or slot in the concrete structure. In another and/or alternative non-limiting embodiment of the invention, the adhesive used to secure the reinforcement strip to an outer surface of the concrete structure and used to connect together the top portion of the anchor to the reinforcement strip can include vinyl ester resins, epoxy resins, polyester resins and/or phenolic resins. In one non-limiting aspect of this embodiment, the adhesive is an epoxy. In another and/or alternative non-limiting aspect of this embodiment, the adhesive used to secure the reinforcement strip to an outer surface of the concrete structure is the same as the adhesive used to connect together the top portion of the anchor to the reinforcement strip. In still another and/or alternative non-limiting embodiment of the invention, the reinforcement strip and/or the top portion of the anchor are generally laminated together and/or laminated to the outer surface of the concrete structure using one or more standard wet application techniques (e.g., painting and/or rolling on adhesive, spraying on adhesive, dipping into an adhesive, etc.); however, this is not required. Several different techniques can be used to adhesively bond the top portion of the anchor to the outer concrete surface and/or to the reinforcement strip. Also, several different techniques can be used to adhesively bond the reinforcement strip to the outer concrete surface. In one non-limiting technique, the bottom surface of the top portion of the anchor is coated with an adhesive and/or the outer surface of the concrete structure is coated with an adhesive. Thereafter, the bottom surface of the top portion of the anchor is positioned on the outer surface of the concrete structure so that an adhesive bond is formed between the top portion of the anchor and the outer surface of the concrete structure. After the bottom surface of the top portion of the anchor is positioned on the outer surface of the concrete structure, pressure can be optionally applied to the top surface of the top portion of the anchor to ensure proper bonding of the top portion of the anchor to the outer surface of the concrete structure. In addition to or alternatively, an adhesive can be applied to the top surface of the top portion of the anchor before, during or after the top portion of the anchor is positioned on the outer surface of the concrete structure. The adhesive applied to the top surface of the top portion of the anchor can be the same or different as the adhesive on the bottom surface of the top portion of the anchor. The manner of application and/or amount of adhesive applied to the top portion of the anchor can be selected to substantially saturate the top portion of the anchor with adhesive; however, this is not required. In another and/or alternative non-limiting technique, the bottom surface of the reinforcement strip can be coated with an adhesive and/or the outer surface of the concrete structure can be coated with an adhesive. Thereafter, the bottom surface of the reinforcement strip can be positioned on the outer surface of the concrete structure so that an adhesive bond is formed between the reinforcement strip and the outer surface of the concrete structure. After the bottom surface of the reinforcement strip is positioned on the outer surface of the concrete structure, pressure can be optionally applied to the top surface of the reinforcement strip to ensure proper bonding of the reinforcement strip to the outer surface of the concrete structure. In addition to or alternatively, an adhesive can be applied to the top surface of the reinforcement strip before, during, or after the reinforcement strip is positioned on the outer surface of the concrete structure. The adhesive applied to the top surface of the reinforcement strip can be the same or different as the adhesive on the bottom surface of the reinforcement strip. The manner of application and/or amount of adhesive applied to the reinforcement strip can be selected to substantially saturate the reinforcement strip with adhesive; however, this is not required. If additional reinforcement strips are to be used, the bottom surface of a second reinforcement strip can be applied to the top surface of the reinforcement strip that is adhesively connected to the outer surface of the concrete structure. The techniques used to connect the reinforcement strip to the outer surface of the concrete structure can also be used to connect a second reinforcement strip to the first reinforcement strip. As can be appreciated, more than two reinforcement strips can be adhesively stacked on one another. In still another and/or alternative non-limiting technique, the bottom and/or top surface of the top portion of the anchor is coated with an adhesive and/or one or more regions of the reinforcement strip is coated with an adhesive. Thereafter, the bottom and/or top surface of the top portion of the anchor is connected to the top surface, bottom surface and/or interior region of the reinforcement strip so that an adhesive bond is formed between the top portion of the anchor and the reinforcement strip. After the top portion of the anchor is adhesively connected to the reinforcement strip, pressure can be optionally applied to the top surface of the top portion of the anchor and/or the reinforcement strip to ensure proper bonding of the top portion of the anchor to the reinforcement strip. In addition to or alternatively, an adhesive can be applied to the top surface of the top portion of the anchor and/or the top surface of the reinforcement strip before, during, or after the top portion of the anchor is connected to the reinforcement strip. The adhesive applied to the top surface of the top portion of the anchor and/or top surface of the reinforcement strip can be the same or different as the adhesive previously applied to the top portion of the anchor and/or reinforcement strip. The manner of application and/or amount of adhesive applied to the top portion of the anchor and/or end portion of the reinforcement strip can be selected to substantially saturate the top portion of the anchor and/or end portion of the reinforcement strip with adhesive; however, this is not required.

In another and/or alternative non-limiting aspect of the present invention, one or more anchors can be connected to the reinforcement strip in various locations on the reinforcement strip. Generally, at least one anchor is connected to each end of the reinforcement strip. As can be appreciated, more than one anchor can be secured to one or both ends of the reinforcement strip. As can also or alternatively be appreciated, one or more anchors can be connected at a location between the ends of the reinforcement strip.

In still another and/or alternative non-limiting aspect of the present invention, the top portion of at least one anchor and a portion of the end portion of the reinforcement strip are connected together by a portion of the top portion of the anchor overlapping a portion of the reinforcement strip. Such overlapping can be accomplished by 1) a portion of the end portion of the reinforcement strip overlying a portion of the top portion of the anchor and one or more adhesives used to secure such overlying portions together, 2) a portion of the top portion of the anchor overlying a portion of the end portion of the reinforcement strip and one or more adhesives used to secure such overlying portions together, 3) a portion of the top portion of the anchor positioned between two or more layers (e.g., fiber layers, fabric layers) at the end portion of the reinforcement strip and one or more adhesives used to secure such overlying portions together, and/or 4) a portion of the end portion of the reinforcement strip positioned between two or more layers (e.g., fiber layers, fabric layers) of the top portion of the anchor and one or more adhesives used to secure such overlying portions together. As can be appreciated, the type of connection between the one or more anchors at each end portion of the reinforcement strip can be the same or different.

In still another and/or alternative non-limiting aspect of the present invention, a slot is cut into the concrete structure so that the anchor can be partially inserted into the cut slot. The size, length and depth of the slot are selected to ensure that the anchor is inserted into the concrete structure. Generally, only one anchor is placed in a slot; however, it can be appreciated that more than one anchor can be placed in a slot. In one non-limiting embodiment of the invention, the slot width is greater than the width of the bottom portion of the anchor. The greater slot width enables the adhesive to be placed in the slot along with the bottom portion of the anchor. In one non-limiting aspect of the present invention, the slot width is at least about 0.1 inches greater than the width of the bottom portion of the anchor. In another and/or alternative non-limiting aspect of the present invention, the slot width is at least about 0.125 inches greater than the width of the bottom portion of the anchor. In still another and/or alternative non-limiting aspect of the present invention, the slot width is at least about 0.1875 inches greater than the width of the bottom portion of the anchor. In still yet another and/or alternative non-limiting aspect of the present invention, the slot width is up to about 0.5 inches greater than the width of the bottom portion of the anchor. In another and/or alternative non-limiting aspect of the present invention, the slot width is up to about 0.4 inches greater than the width of the bottom portion of the anchor. In still another and/or alternative non-limiting aspect of the present invention, the slot width is up to about 0.25 inches greater than the width of the bottom portion of the anchor. The slot width may or may not be constant along the longitudinal length of the slot. It has been found that the wobble and variation of slot width can enhance the bond between the concrete and anchor by adding texture to the inside surface of the slot. In another and/or alternative one non-limiting embodiment of the invention, the slot depth is the same as or greater than the longitudinal length (e.g., height) of the bottom portion of the anchor; however, this is not required. The greater slot depth enables the adhesive to be placed in the slot along with the bottom portion of the anchor so that the top of the bottom portion is flush with, or below the surface of the concrete structure when the bottom portion is secured to the concrete structure. In one non-limiting aspect of the present invention, the slot depth is at least about 0.1 inches greater than the longitudinal length of the bottom portion of the anchor. In another and/or alternative non-limiting aspect of the present invention, the slot depth is at least about 0.125 inches greater than the longitudinal length of the bottom portion of the anchor. In still another and/or alternative non-limiting aspect of the present invention, the slot depth is up to about 1 inch greater than the depth of the bottom portion of the anchor. In yet another and/or alternative non-limiting aspect of the present invention, the slot depth is up to about 0.5 inches greater than the depth of the bottom portion of the anchor. In still yet another and/or alternative non-limiting aspect of the present invention, the slot depth is up to about 0.25 inches greater than the depth of the bottom portion of the anchor. The slot depth may or may not be constant along the longitudinal length of the slot. The depth profile of the slot can be selected to generally follow the shape profile of the bottom portion of the anchor; however, this is not required. In still another and/or alternative non-limiting embodiment of the invention, the slot length generally is greater than the width of the bottom portion of the anchor. In one non-limiting aspect of the present invention, the slot length is at least about 0.1 inch greater than the width of the bottom portion of the anchor. In another and/or alternative non-limiting aspect of the present invention, the slot length generally is at least about 0.125 inch greater than the width of the bottom portion of the anchor. In still another and/or alternative non-limiting aspect of the present invention, the slot length generally is at least about 0.25 inch greater than the width of the bottom portion of the anchor. In yet another and/or alternative non-limiting aspect of the present invention, the slot length generally is up to about 1 inch greater than the width of the bottom portion of the anchor. Due to the stresses induced into the concrete structure during the forming of the slot and the loads applied to the concrete structure, the length of the slot generally is controlled. In still yet another and/or alternative non-limiting aspect of the present invention, the slot length generally is about 0.125-0.75 inches greater than the width of the bottom portion of the anchor. In another and/or alternative non-limiting aspect of the present invention, the slot length generally is about 0.25-0.75 inches greater than the width of the bottom portion of the anchor. In still another and/or alternative non-limiting aspect of the present invention, the slot length generally is about 0.25-0.5 inches greater than the width of the bottom portion of the anchor.

In yet another and/or alternative non-limiting aspect of the present invention, a slot is cut into the concrete structure in a direction that is generally perpendicular or parallel to the longitudinal axis of the reinforcement strip that is connected to the outer surface of the concrete structure. As can be appreciated, the slot can be cut at other angles (e.g., 45°, 60°, 120°, 135°, etc.) to the longitudinal axis of the reinforcement strip that is connected to the outer surface of the concrete structure. Generally, at least two of the slots that are cut in the concrete structure for securing an anchor for use with a particular reinforcement strip are cut generally parallel to one another; however, that is not required.

In still yet another and/or alternative non-limiting aspect of the present invention, the adhesive used to bond the bottom portion of the anchor in the cut slot is generally a different composition from the adhesive used to secure the reinforcement strip to the outer surface of the concrete structure. Generally, the curing time of the adhesive used to secure the bottom portion of the anchor in the cut slot is about 1-10 hours, depending on the ambient temperature. Generally, the curing time of the adhesive used to secure the bottom portion of the anchor is less than the curing time of the adhesive used to bond the reinforcement strip to the outer surface of the concrete structure. This curing time difference is advantageous to create the desired reinforcement structure.

In another and/or alternative non-limiting aspect of the present invention, the adhesive used to secure the bottom portion of the anchor in the slot or opening in the concrete structure generally fills the remaining voids in the cut slot or opening after the bottom portion of the anchor is inserted into the slot or opening. Prior to the adhesive and/or the bottom portion of the anchor being inserted into the slot or opening, the slot or opening is generally cleaned. The slot or opening can be cleaned by various means (e.g., pressurized air, water, cleaning solvent, etc.). In one arrangement, the slot or opening is cleaned out with 30-150 psi or greater oil free compressed air. Generally, adhesive is placed in the slot or opening prior to the bottom portion of the anchor being inserted into the slot or opening. One or both sides of the bottom portion of the anchor can be optionally coated with adhesive prior to the bottom portion of the anchor being inserted into the slot or opening. In one non-limiting arrangement, adhesive is placed in the slot or opening prior to the bottom portion of the anchor being inserted into the slot or opening and both sides of the bottom portion of the anchor are coated with adhesive prior to the bottom portion of the anchor being inserted into the slot or opening.

In still another and/or alternative non-limiting aspect of the present invention, there is provided a novel method for reinforcing concrete structures. The basic steps for the novel method of reinforcing concrete structures are as follows: 1) cutting at least two slots into a concrete structure, 2) inserting the bonded bottom portion of the novel anchor into each of the slots (at least one anchor in each slot), 3) bonding the anchors in each of the slots, 4) bonding the reinforcement strip to the outer surface of the concrete structure, and 5) bonding the reinforcement strip to the novel anchors. The novel method for reinforcing concrete structures can include additional steps; however, this is not required. Such additional steps include, but are not limited to, a) cutting slots into the concrete structure such that at least two of the slots have generally the same slot length, slot width, slot depth, and/or slot profile, b) cutting at least two slots in the concrete structure at angles parallel to one another, c) cutting at least two slots into the concrete structure at angles that are parallel to the longitudinal length of the reinforcement strip, d) cutting at least two slots into the concrete structure at angles that are perpendicular to the longitudinal length of the reinforcement strip, e) cleaning each of the slots prior to inserting the bottom portion of the novel anchor into the cut slots, f) using a certain length, thickness, vertical width, shape and/or composition for the top portion and bottom portion of the novel anchor, g) using a certain length, thickness, and/or composition for the reinforcement strip, h) inserting a bonding material into one or more portions of the slot prior to inserting the bottom portion of the anchor into the slot, i) inserting a bonding material on the bottom portion of the novel anchor prior to inserting the bottom portion of the novel anchor into the slot, j) inserting the bottom portion of the novel anchor into the cut slot until the top edge of the bottom portion of the novel anchor is positioned flush with, or positioned below the top surface of the concrete surface located adjacent to the cut slot, k) bonding the bottom surface of the reinforcement strip to the top surface of the top portion of the novel anchor, l) bonding the upper surface of the reinforcement strip to the bottom surface of the top portion of the novel anchor, m) inserting a portion of the top portion of the novel anchor in between two or more layers of the reinforcement strip and then bonding the top portion of the novel anchor to the reinforcement strip, n) saturating the top surface of the reinforcement strip and/or top surface of the top portion of the novel anchor with adhesive to increase the bond of the anchor and/or reinforcement strip to one another and/or to the concrete structure, o) filling the cut slot with sufficient adhesive to substantially fill all air voids in the cut slot after the bottom portion of the anchor is positioned in the cut slot, p) using a different adhesive to secure the bottom portion of the anchor in the cut slot from the adhesive used to bond together the top portion of the anchor to the end portion of the reinforcement strip, q) using a different adhesive to secure the bottom portion of the anchor in the cut slot from the adhesive used to bond the top portion of the anchor to the concrete structure, r) using a different adhesive to secure the bottom portion of the anchor in the cut slot from the adhesive used to bond the reinforcement strip to the concrete structure, s) bonding multiple layers of reinforcement strip together, t) insert a plurality of novel anchors side by side in a single cut slot, u) forming a certain spread pattern of the non-bonded region of the anchoring system on the surface of the concrete (e.g., the longitudinal axis of the top portion of the novel anchor is parallel to the longitudinal axis of the reinforcement strip), v) connecting more than one anchor at one or both ends of the reinforcement strip, and/or w) connecting one or more anchors to the reinforcement strip at locations that are between the ends of the reinforcement strip. As can be appreciated, one or more of the above listed additional steps can be used in the method of the present invention. Also, it will be appreciated that any combination of the above listed additional steps can be used in the method of the present invention.

It is one non-limiting object of the present invention to provide a method and apparatus for reinforcing concrete.

It is another and/or alternative non-limiting object of the present invention to provide a method and apparatus for reinforcing concrete having improved reinforcement properties over prior art reinforcement arrangements.

It is still another and/or alternative non-limiting object of the present invention to provide a method and apparatus for reinforcing concrete that includes the use of a novel anchor.

It is yet another and/or alternative non-limiting object of the present invention to provide a method and apparatus for reinforcing concrete that is relatively simple and time efficient to install.

These and other objects and advantages will become apparent to those skilled in the art upon reading and following the description taken together with the accompanying drawings.

BRIEF DESCRIPTION OF THE DRAWINGS

Reference may now be made to the drawings which illustrate various non-limiting embodiments that the invention may take in physical form and in certain parts and arrangement of parts wherein.

DETAILED DESCRIPTION OF THE NON-LIMITING EMBODIMENTS

Figure 1:
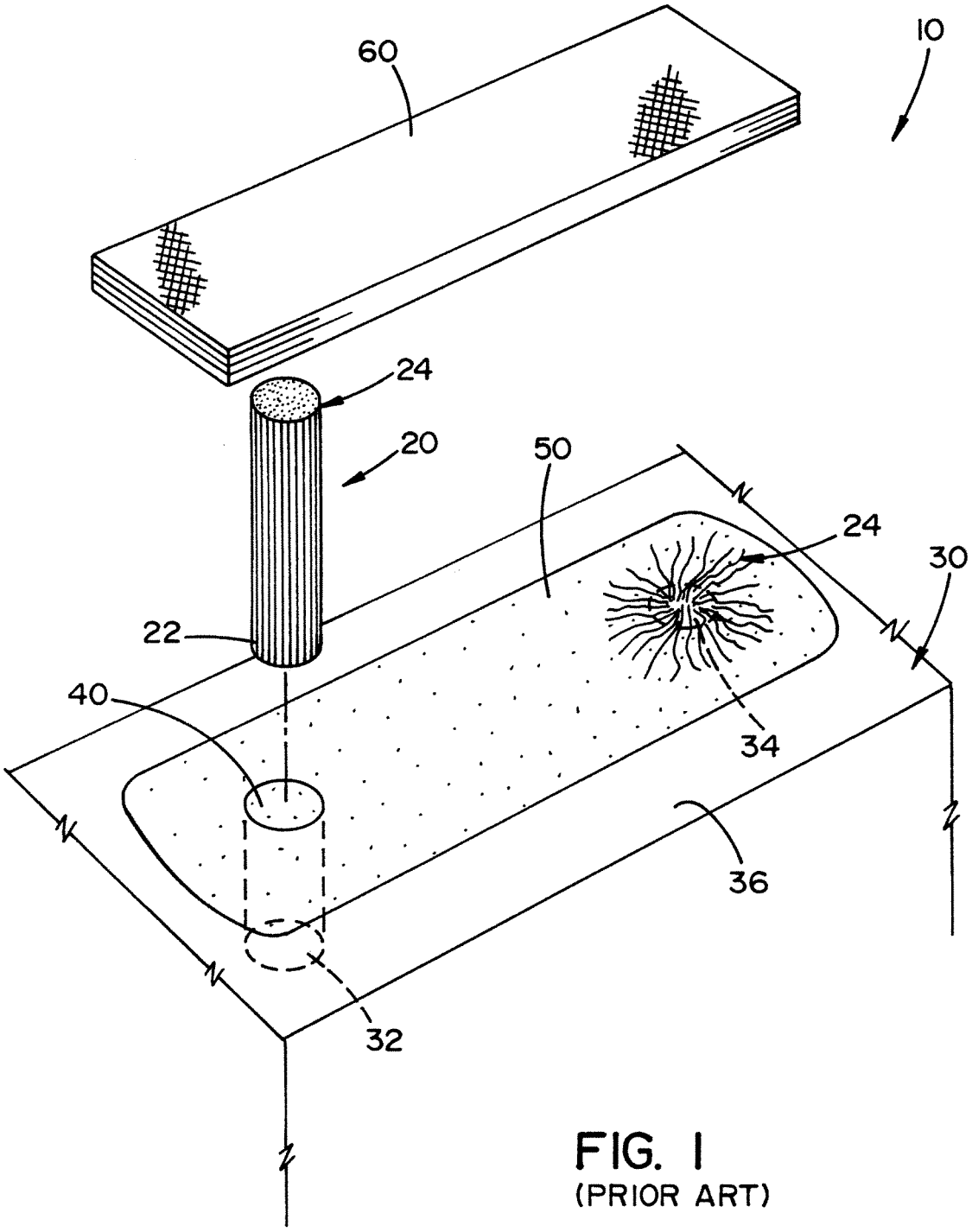
FIG. 1 (PRIOR ART)
FIG. 1 is an exploded view of a prior art anchor system used to secure a reinforcement strip to a concrete structure.

Referring now to the drawings wherein the showings are for the purpose of illustrating preferred embodiments of the invention only and not for the purpose of limiting same, FIG. 1 illustrates a prior art concrete reinforcement system 10. FIG. 1 illustrates the use of a fiber reinforcement strip, such as a Carbon Fiber Reinforced Plastic (CFRP) sheet, to strengthen a concrete structure. One of the major problems associated with the reinforcing of concrete with fiber reinforced strips is the debonding of the reinforcement strip from the concrete structure before the reinforcement strip has achieved its maximum potential strength in reinforcing the concrete structure. To address this debonding problem, anchors have been used with the fiber reinforcement strip to prevent the debonding of the fiber reinforcement strips from the concrete structure. A common type of anchor that has been used is the Splay anchor. This type of anchor is illustrated in FIG. 1. These types of anchors are placed in pre-drilled holes with the top portion of the anchor splayed out over the hole. Another type of prior art anchor, not shown, is an anchor similar to a Splay anchor, but includes a reapplied resin material on the bottom portion of the anchor. This type of anchor is commercially offered by Fyfe Company LLC (Fyfe) and will be hereinafter referred to as a Fyfe anchor.

Referring again to FIG. 1, the prior art Splay anchor 20 is similar to the anchors disclosed in U.S. Pat. No. 7,574,840; and in two articles entitled *Design Considerations of Carbon Fiber Anchors* , published November/December 2008, and entitled "*CFRP Composite Connector for Concrete Members*" published February 2003, all of which are fully incorporated herein by reference. FIG. 1 illustrates a concrete structure 30 in the form of a concrete beam; however, it can be appreciated that the concrete structure can have some other form. Two holes 32, 34 are formed in the concrete structure. These holes are generally pre-drilled into the concrete structure. The holes are designed to receive a bottom portion 22 of anchor 20. The anchor is formed of a bundle of fibers. The fiber bundle can be optionally tied together, not shown, about the perimeter of the fiber bundle so as to maintain the fiber bundle in a form for easier insertion in the holes in the concrete; however, this is not required. The bottom portion of the fiber bundle can also or alternatively be optionally dipped in an adhesive, not shown, to maintain together the fiber in the bottom portion of the fiber bundle so as to facilitate in easier insertion of the bottom portion of the fiber bundle into the holes in the concrete; however, this is not required. Such a dipped fiber bundle is a type of Fyfe anchor.

An adhesive 40 is inserted into holes 32, 34 before, during, or after the bottom portion of the anchor is inserted into each hole so as to secure the bottom portion of the anchor in the hole. After the bottom portion of the anchor is placed in the holes on the concrete structure, the fibers that form the top portion 24 of the anchor are spread or splayed on the surface 36 of the concrete structure. An adhesive 50 is used to secure the fibers to the top surface of the concrete structure. Once the fibers of the top portion of the anchor are spread on the top surface of the concrete structure, a reinforcement strip 60 is adhesively secured to the fibers of the top portion of the anchor and to the top surface of the concrete structure. Generally, the same adhesive used to secure the fibers of the top portion of the anchor to the top surface of the concrete structure is also used to secure the reinforcement strip to the fibers of the top portion of the anchor and to the top surface of the concrete structure; however, this is not required.

The purpose of the Splay anchor is to ensure that the reinforcement strip used to reinforce the concrete structure reaches its maximum capacity. The anchors are used to address the problem of debonding between the concrete and the reinforcement strip. The bond between the reinforcement strip and the concrete structure is much weaker than the strength of the concrete structure and the reinforcement strip. When a concrete beam or column is bending due to a load being applied to the column, the peeling stresses between the reinforcement strip and the concrete structure increase, thus accelerating the rate of debonding of the reinforcement strip from the concrete structure. The Splay anchors are used to ensure that the reinforcement strip and the concrete hold together long enough so that the reinforcement strip reaches its maximum capacity, thus maximizing the reinforcement strength provided by the reinforcement strip. Although the Splay anchors and the Fyfe anchors do increase loads that a concrete structure can withstand, the prior art anchors are unable to maintain the reinforcement strip on the concrete structure until the reinforcement strip reaches its maximum tensile strength and starts to fail.

Figure 2:
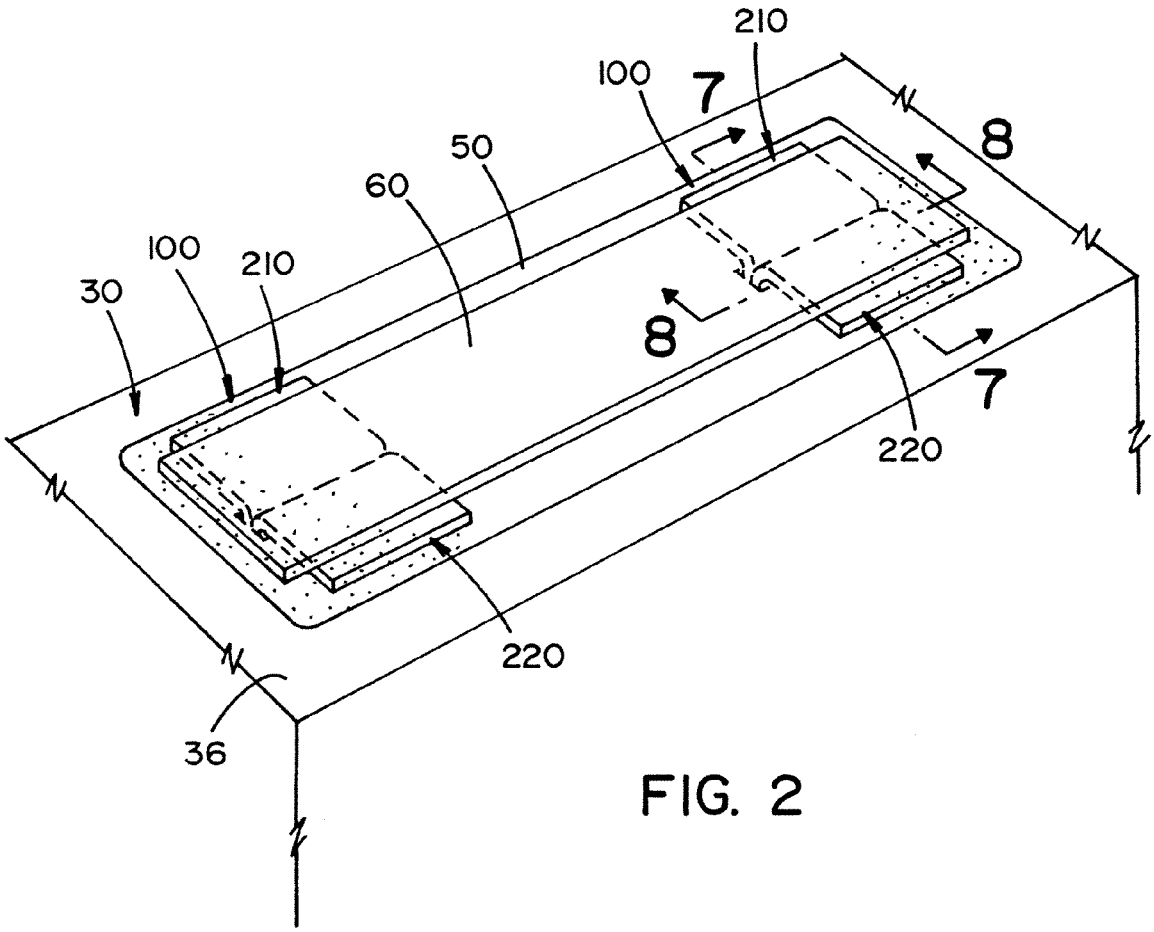
FIG. 2 is a top elevation view of one non-limiting arrangement of the reinforcement arrangement of the present invention secured to a concrete structure.

Referring now to FIGS. 2-12, there is illustrated an improved anchor arrangement in accordance with the present invention. FIG. 2 illustrates a concrete structure such as a concrete block, concrete beam, or another other concrete structure that is designed to support a load. The size, shape and thickness of the concrete structure is non-limiting. Although the anchoring system of the present invention is specifically designed for use with concrete structures and will be described with particular reference thereto, the anchoring arrangement can be used to support other types of structures (e.g., wood structures, ceramic structures, composite material structures, plastic structures, metal structures, etc.). The reinforcement strip 60 illustrated in FIG. 2 can be the same size, thickness, shape, and composition as the reinforcement strip illustrated in FIG. 1; however, this is not required. The reinforcement strip is illustrated as adhesively connected to the surface 36 of the concrete structure by an adhesive 50. The adhesive used to secure the reinforcement strip to the concrete structure can be the same as the adhesive used to secure the reinforcement strip to the concrete structure in FIG. 1; however, this is not required. Generally, the adhesive is an epoxy; however, other or additional types of adhesive can be used.

As illustrated in FIG. 2, the reinforcement strip is also adhesively secured to the anchor 100 that is in accordance with the present invention. As illustrated in FIGS. 2 and 9-12, the reinforcement strip can be secured to one or more anchors 100 in a number of ways. As can be appreciated, the reinforcement strip can be secured to one or more anchors 100 in alternative or additional ways; however, this is not required. For example, FIGS. 2 and 9-12 illustrate that the reinforcement strip is connected on top of a portion of the anchor; however, it can be appreciated that the anchor can be connected on top of the reinforcement strip. Also, FIGS. 2 and 9-12 illustrate that each end portion of the reinforcement strip can be connected in the same or similar manner to an anchor; however, it can be appreciated that one portion of the reinforcement strip can be connected in one way (e.g., FIG. 2) and the other end portion of the reinforcement strip can be connected in another way (e.g., FIG. 10 or 11).

Figure 4:
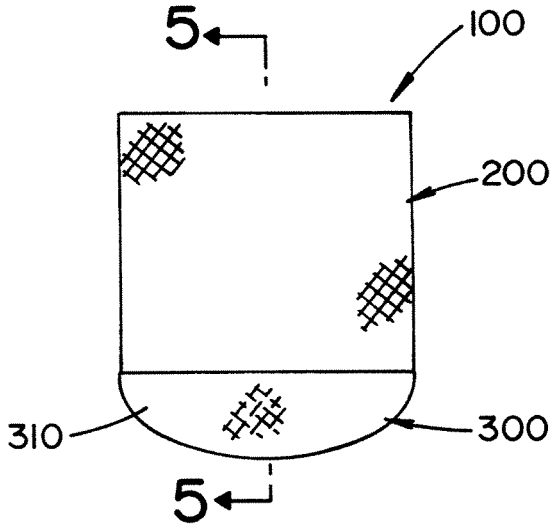
FIG. 4 is a front plan view of the novel anchor that forms a part of the reinforcement arrangement of the present invention.
Figure 5:
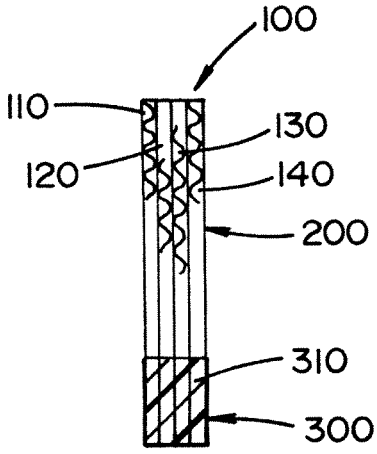
FIG. 5 is a cross-sectional view along lines 5-5 of FIG. 4.

Referring now to FIGS. 4 and 5, one non-limiting embodiment of the anchor 100 of the present invention is illustrated. Anchor 100 is illustrated as including four layers 110, 120, 130, 140. As can be appreciated, the anchor may only include two or three layers or more than four layers. At least two of the layers of the anchor are fabric layers. The manner in which the fabric layers are formed is non-limiting. The composition of the fabric layers can be the same or different. In one non-limiting arrangement, fabric layers 120, 130 are formed of the same composition, and layers 110 and 140 are formed of the same composition. In one non-limiting specific design, fabric layers 120, 130 are carbon composite fabric layers and layers 110, 140 are fiberglass fabric layers. As can be appreciated, other or additional types of fabric layers can be used.

The anchor is divided into a top portion 200 and a bottom portion 300. The bottom portion 300 illustrates the four fabric layers being connected together by an adhesive material 310 such as, but not limited to, a two-part epoxy material. Generally, adhesive material 310 is different from adhesive material 50; however, this is not required. As can be appreciated, two or more of the fabric layers at the bottom portion of the anchor can be secured together by other or additional means (e.g., heat bonding, stitching, mechanical connection, weaving, etc.). Adhesive material 310 is generally saturated in all of the fabric layers of the bottom portion of the anchor; however, this is not required. Adhesive material 310 is generally cured prior to the bottom portion of the anchor being connected to the concrete block; however, this is not required.

The layers of fabric material in the top portion of the anchor are not all connected together. Specifically, fabric layers 120 and 130 are not connected together so that the two fabric layers can be laid open on the concrete surface 36 as illustrated in FIGS. 2, 3, 6, 7 and 9-12. As can be appreciated, other or additional fabric layers can be arranged so as to be not connected to other fabric layers in the top portion of the anchor. Fabric layer 110 can be connected to fabric layer 120 by one or more means (e.g., stitching, adhesive, heat bonding, mechanical connection, etc.); however, this is not required. Likewise, fabric layer 130 can be connected to fabric layer 140 by one or more means (e.g., stitching, adhesive, heat bonding, mechanical connection, etc.); however, this is not required.

As best illustrated in FIGS. 4 and 5, the longitudinal length of the top portion is greater than the longitudinal length of the bottom portion. Generally, the longitudinal length ratio of the bottom portion to the top portion is about 0.05-0.95:1, typically about 0.1-0.9:1, more typically about 0.15-0.8:1, and still more typically about 0.2-0.5:1. The width of the anchor is also generally less than the longitudinal length of the anchor. The thickness of the anchor is generally less than about 50% the width of the anchor. Typically, the thickness of the anchor is about 0.1-25% the width of the anchor, more typically about 0.2-25% the width of the anchor, and even more typically about 0.4-10% the width of the anchor. The bottom portion 300 of the anchor can be cut so as to have a curved bottom profile or edge; however, this is not required.

Figure 3:
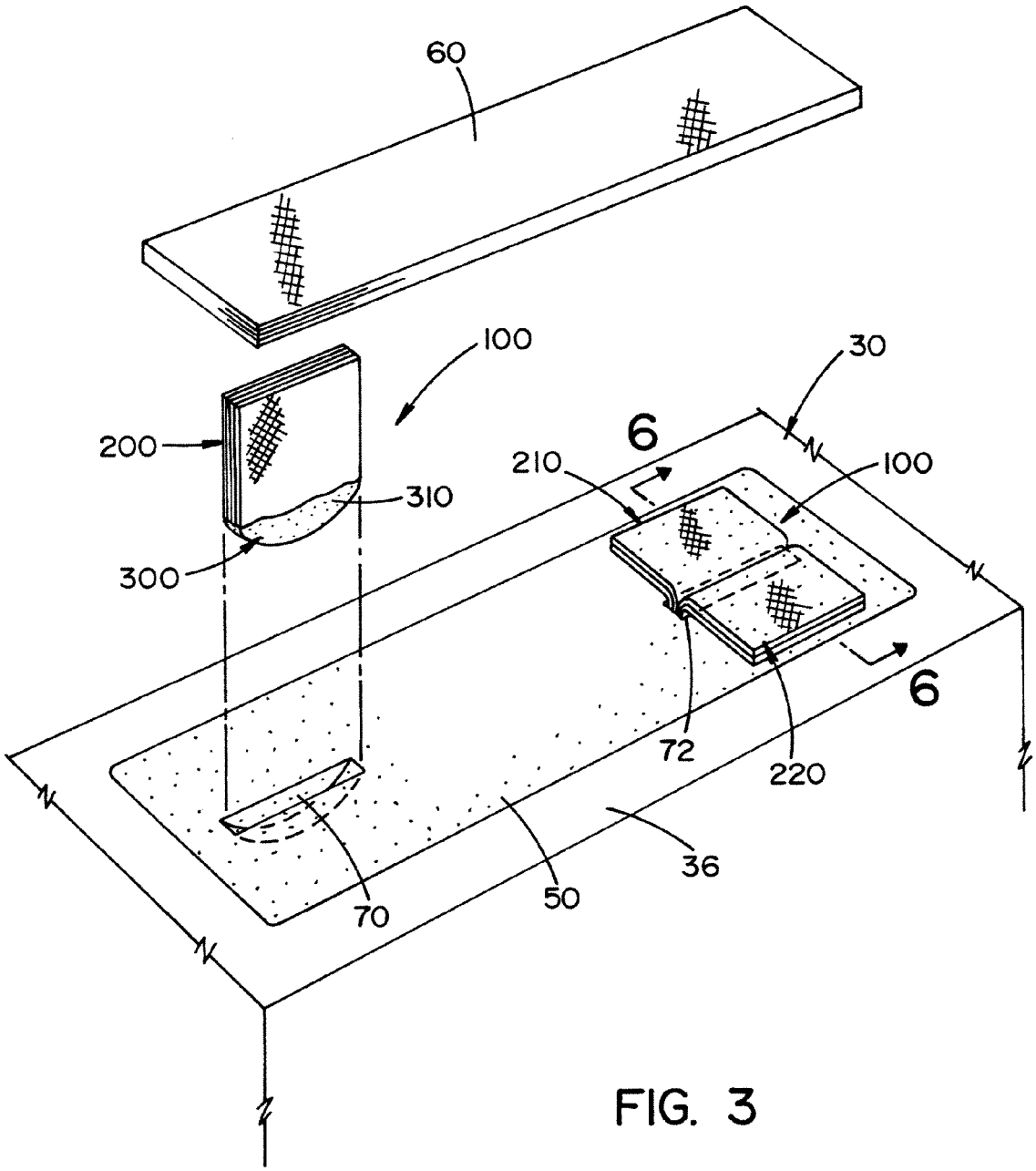
FIG. 3 is an exploded view of the reinforcement arrangement illustrated in FIG. 2.
Figure 6:
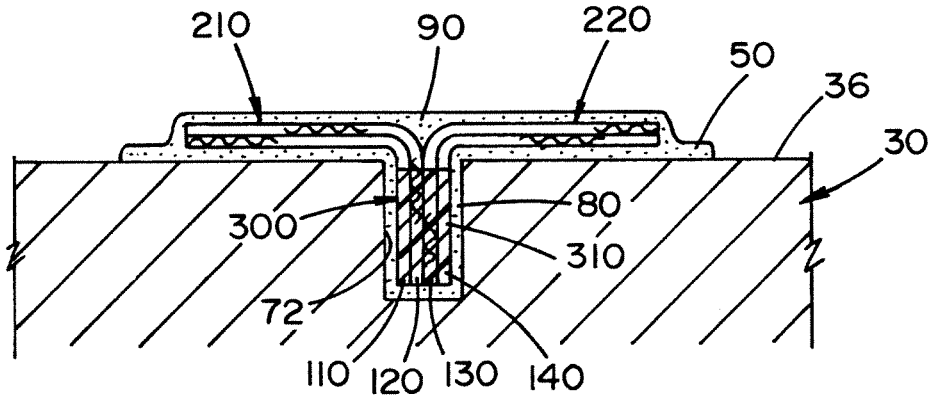
FIG. 6 is a cross-sectional view along lines 6-6 of FIG. 3.
Figure 7:
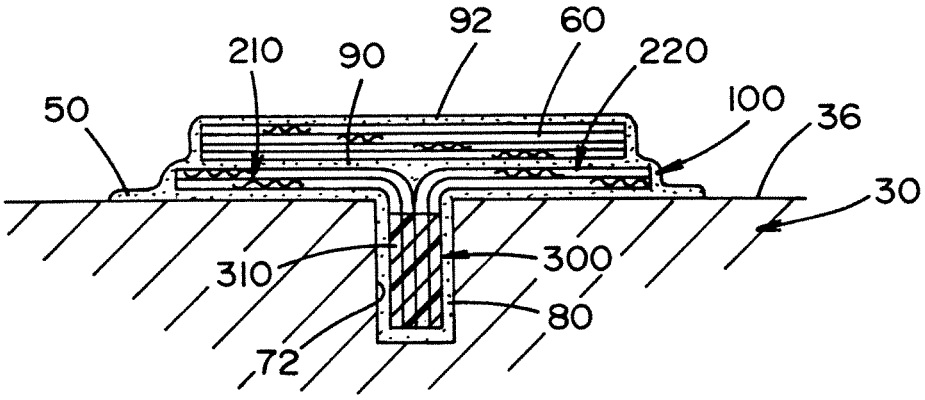
FIG. 7 is a cross-sectional view along lines 7-7 of FIG. 2.
Figure 8:
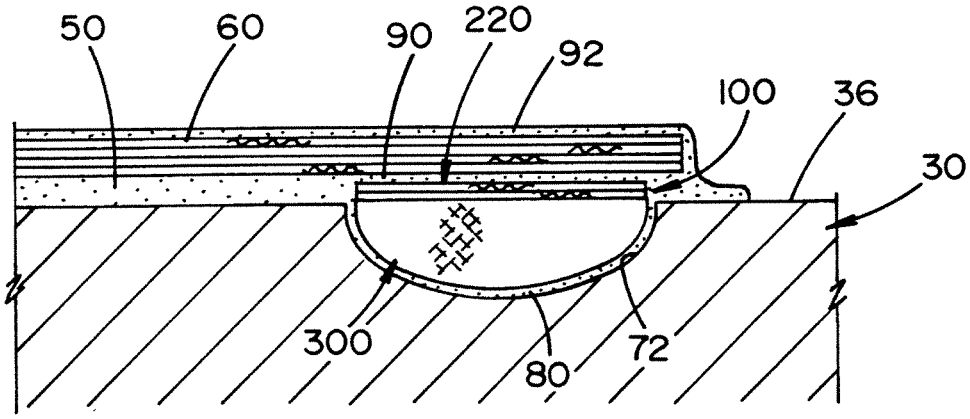
FIG. 8 is a cross-sectional view along lines 8-8 of FIG. 2.

Referring now to FIG. 3, the concrete structure 30 is illustrated as including two slots 70, 72. These slots are generally cut such as by a saw or other means; however, it can be appreciated that the slot could be preformed in the concrete structure. When the slots are formed by a circular saw, the profile of the slot is generally half circle-shaped or hemispherical as illustrated in FIG. 3. Generally, the slot is partially or fully filled with an adhesive prior to the bottom portion 300 of the anchor being inserted into the slot; however, this is not required. The bottom portion 300 can be partially or fully coated with an adhesive prior to being inserted into the slot; however, this is not required. As illustrated in FIG. 6, the slot is cut so that the top of the bottom portion can be inserted even with or below the surface 36 of the concrete block; however, this is not required. Adhesive 80 is used to secure the bottom portion of the anchor in the slot. Adhesive 80 is generally a different adhesive from adhesive material 310; however, this is not required. Adhesive 80 may be the same as adhesive 50; however, this is not required.

Once the bottom portion of the anchor is inserted into the slot in the concrete structure, the first and second flap portions 210, 220 are opened and laid over surface 36 as illustrated in FIGS. 2, 3, 6, 7 and 9-12. The flap portions can be adhesively secured to surface 36 by adhesive 50 and/or some other adhesive; however, this is not required. After the flap portions are laid open, the reinforcement strip can be inserted onto surface 36 and adhered to surface 36 by adhesive 50 as illustrated in FIG. 2. An adhesive 90 can be used to secure the reinforcement strip to one or both flap portions. Adhesive 90 can be the same or different adhesive from adhesive 50. An adhesive layer 90 can be applied over the top surface of the reinforcement strip; however, this is not required. Adhesive 92 can be the same or different from adhesive 50.

Figure 9:
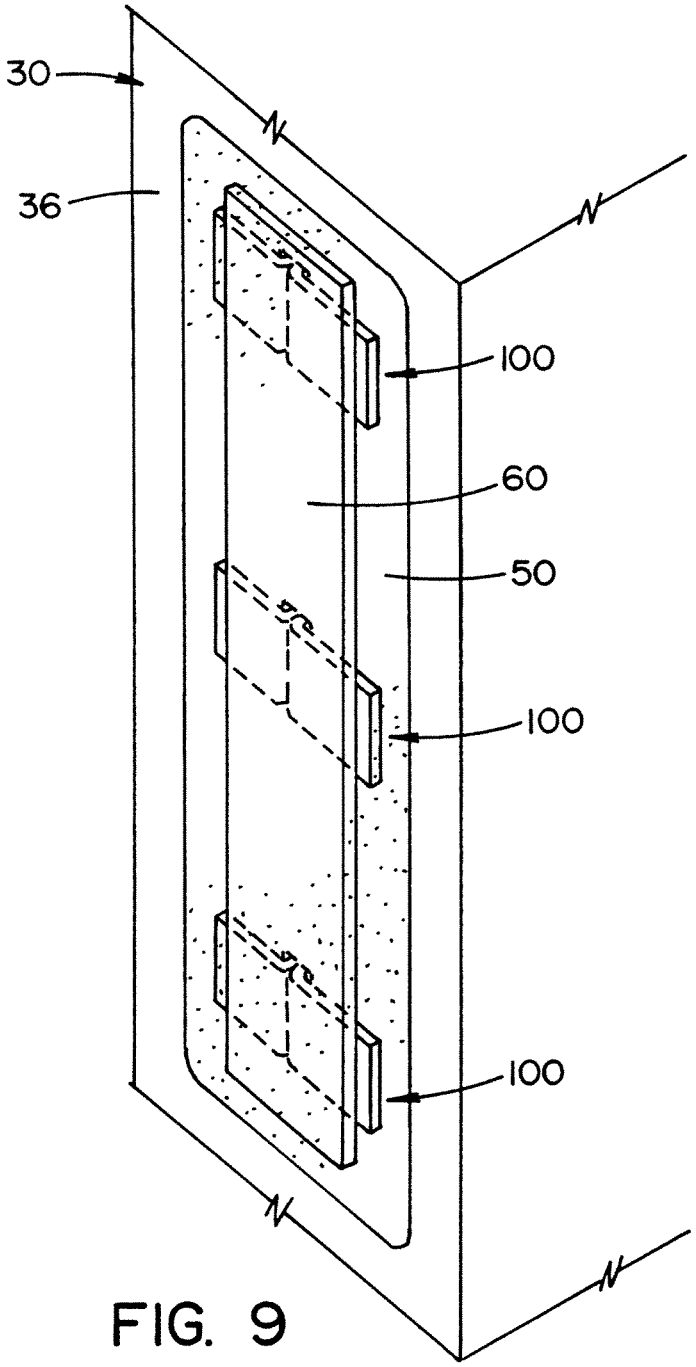
FIG. 9 is a top elevation view of one non-limiting arrangement of the reinforcement arrangement of the present invention secured to a concrete structure.
Figure 10:
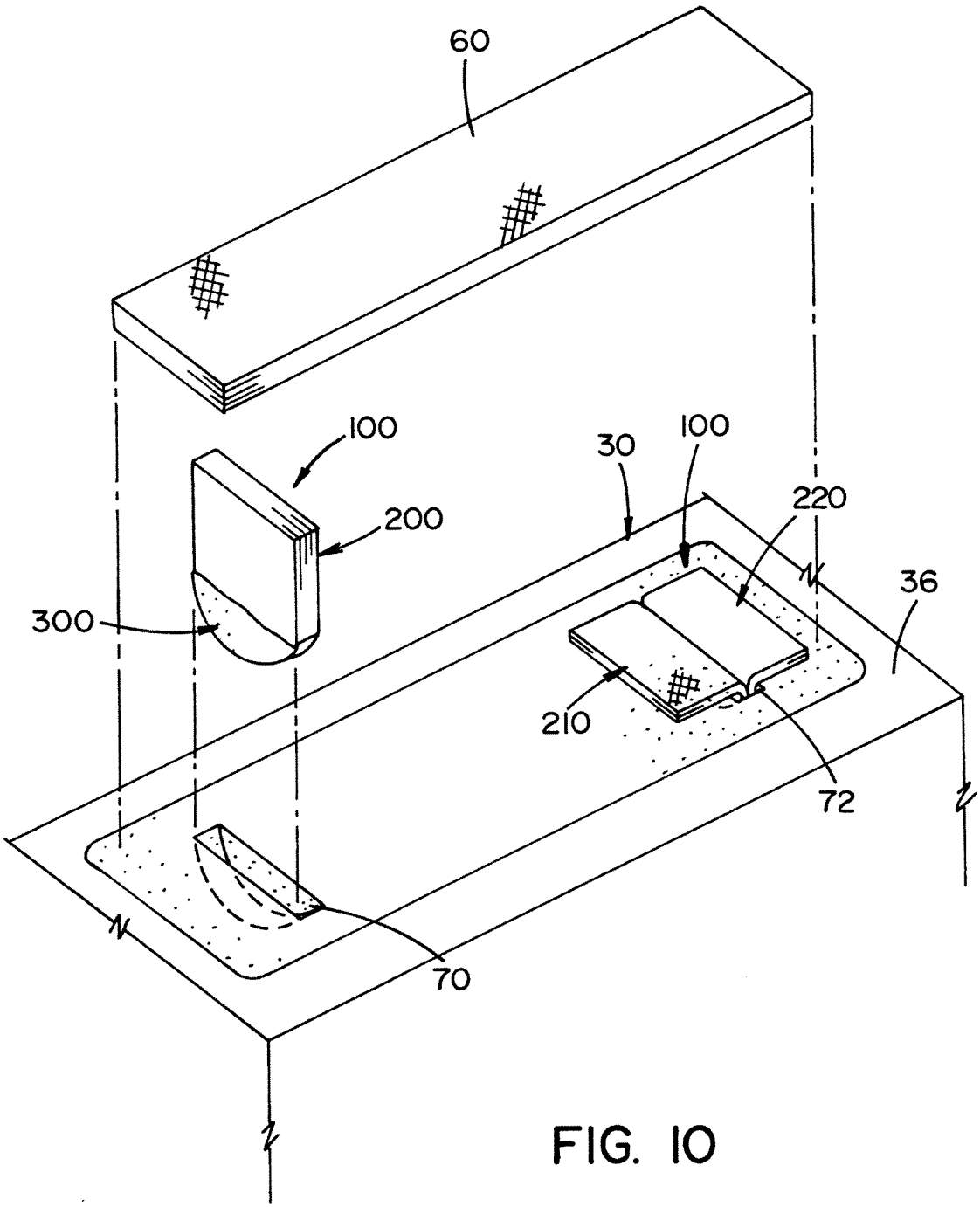
FIG. 10 is an exploded view of a portion of the reinforcement arrangement illustrated in FIG. 9.

The slot that is cut or formed in the concrete block can be cut perpendicular to the longitudinal length of the reinforcement strip (See FIGS. 10-12) or parallel to the longitudinal length of the reinforcement strip (See FIGS. 2, 3 & 9). As can be appreciated, the slot can be cut or formed at other angles to the longitudinal length of the reinforcement strip. As can also be appreciated, multiple slots can be cut or formed parallel or nonparallel to one another.

Figure 11:
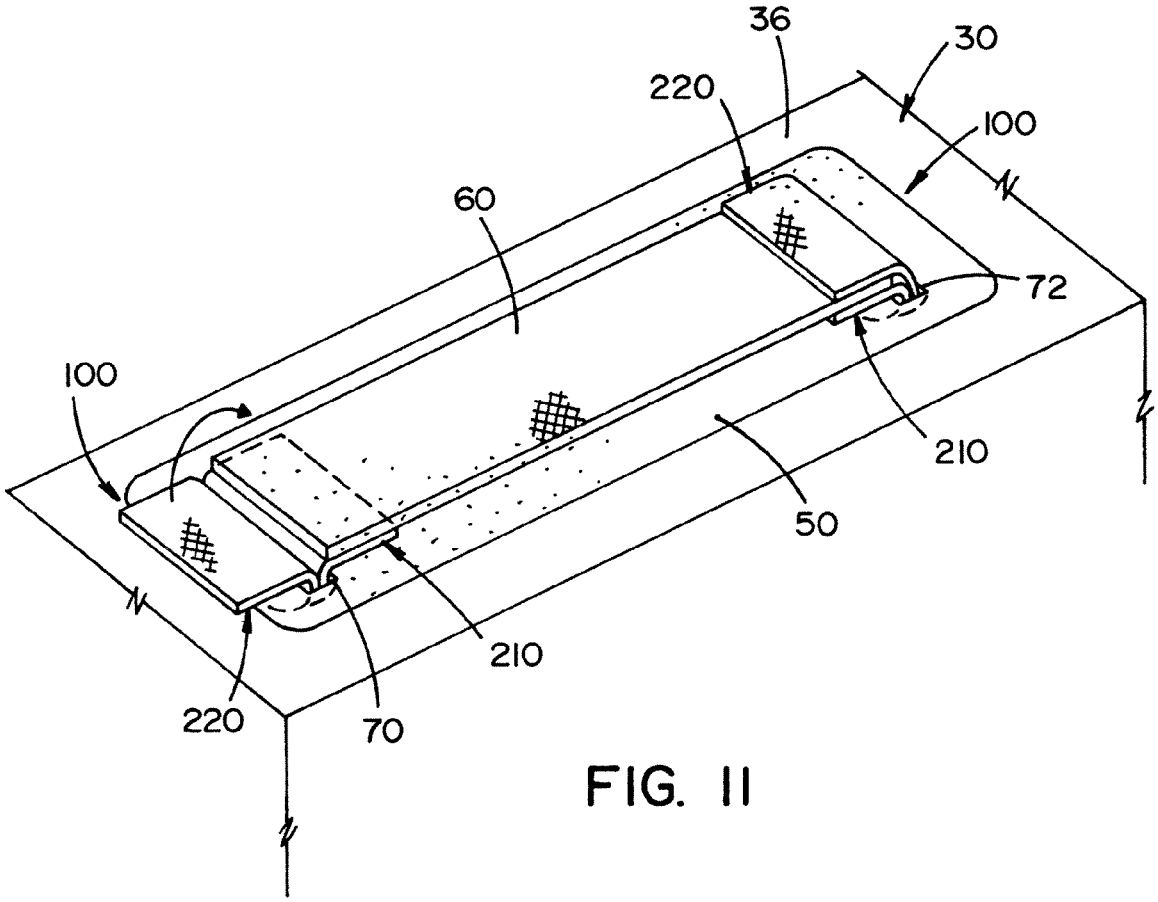
FIG. 11 is a top elevation view of one non-limiting arrangement of the reinforcement arrangement of the present invention secured to a concrete structure.
Figure 12:
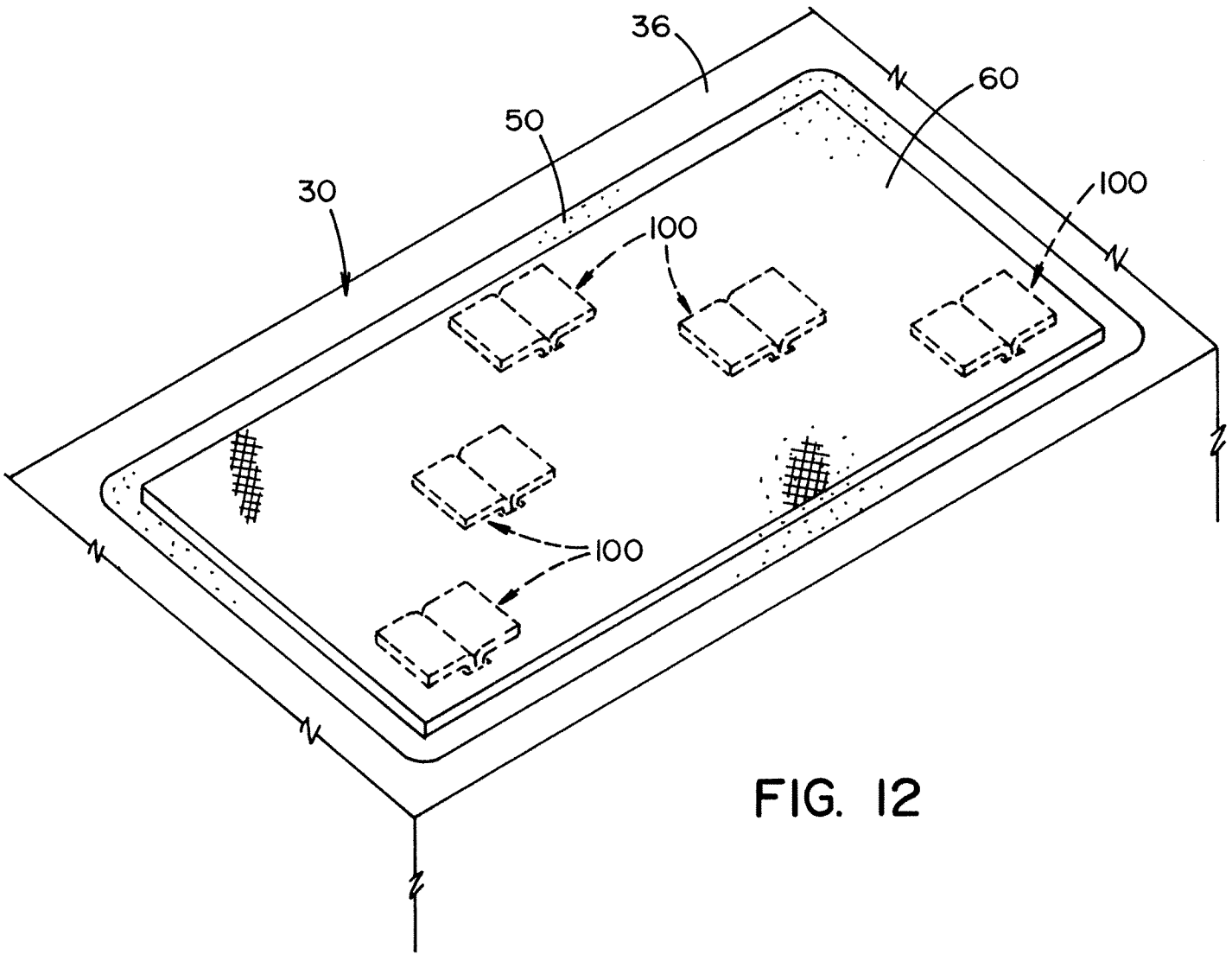
FIG. 12 is a top elevation view of one non-limiting arrangement of the reinforcement arrangement of the present invention secured to a concrete structure.

As illustrated in FIGS. 2, 3, 7-10 & 12, the bottom surface of the reinforcement strip is connected to the top surface of the flap portions of the anchor. As can be appreciated, the top surface of the reinforcement strip can be connected to the bottom surface of the flap portions of the anchor. As can also be appreciated, more than two anchors can be connected to a reinforcement strip as illustrated in FIGS. 9 & 12. The positioning of the anchors relative to the reinforcement strip is non-limiting. Another connection arrangement is illustrated in FIG. 12. In FIG. 12, the anchors are positioned in a step relative to one another along the longitudinal length of the reinforcement strip. Referring to FIG. 11, the end portion of the reinforcement strip is sandwiched between the two flap portions of the anchor.

Figure 13:
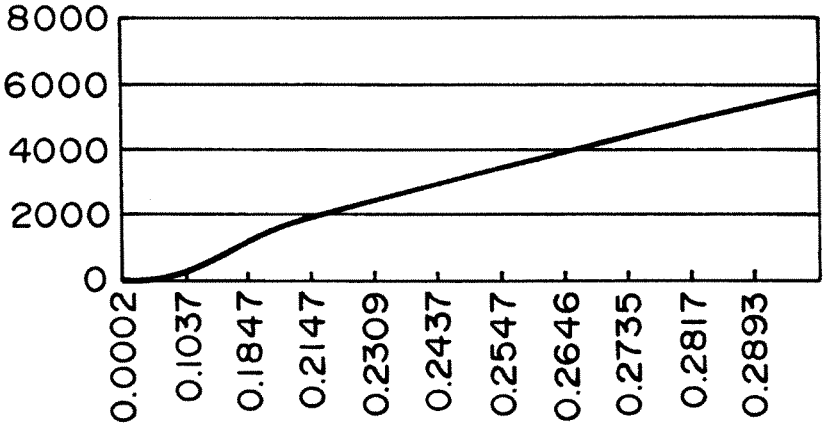
FIGS. 13-15 are load vs. displacement graphs for several concrete block samples that include a reinforcement strip; and, FIG. 16 is a bar graph of the load results of several concrete block samples.
Figure 14:
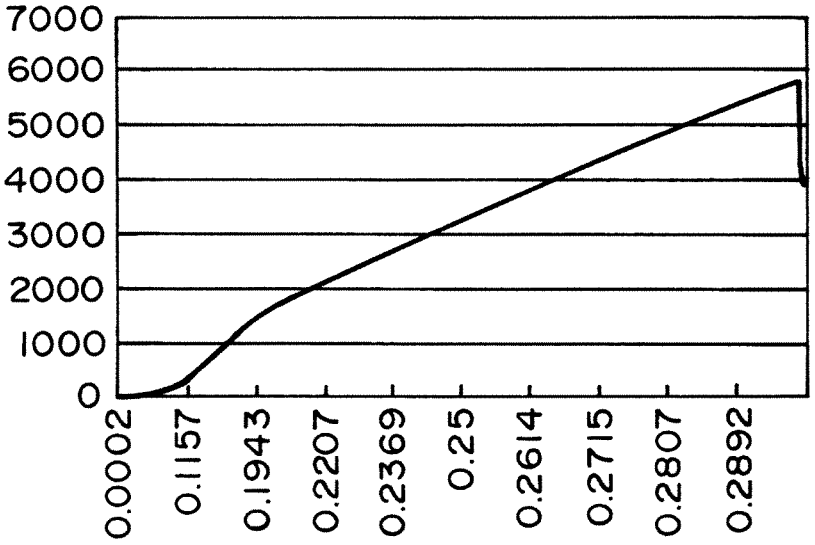
Figure 15:
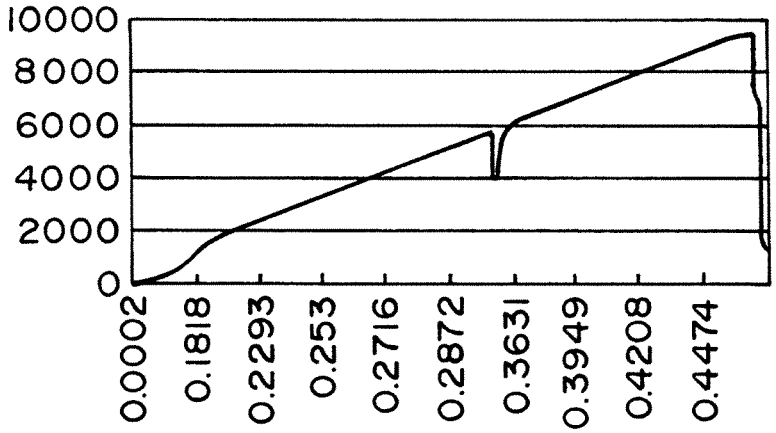

The anchor of the present invention was compared to the Splay anchor illustrated in FIG. 1 and to a Fyfe anchor. The test used to compare these three types of anchors was a three-point bend on a preformed concrete block having a carbon reinforcement strip bonded to the underside of the concrete block. When a load was being applied to the concrete samples, the carbon reinforcement strip, anchors and concrete all acted as one unit, with the weak link being the concrete block. At some point during the load test (dependent on the concrete compressive strength at the time of testing), the concrete reached its maximum tensile capacity. Once this maximum tensile capacity of the concrete was reached, a crack in the center of the concrete block formed. At the point of crack formation in the concrete block, the bond between the carbon reinforcement strip and the concrete will also be mostly broken (due to debonding of the reinforcement strip from the concrete block) and all of the load will be transferred through the block to the carbon reinforcement strip and the two anchors. The load vs. displacement graphs of FIGS. 13-15 illustrate this phenomena. FIG. 13 illustrates the maximum load the concrete block could maintain before failure. As illustrated in FIGS. 13 and 14, the concrete blocks consistently failed at about 6000 lbs. When the anchors of the present invention were used to reinforce the concrete block, the concrete block failed at over 9000 lbs.

For the samples of concrete blocks that included anchors and a reinforcement strip, one of three things would happen at the time of concrete block failure. The first type of failure observed was that the concrete block would fail. The concrete block would either shear (shear reinforcement was added to the concrete block to try and prevent or at least delay this type of failure) or there would be a concrete cone failure. The second type of failure observed, was that the anchor would fail, either because the bond between the anchor and the concrete failed or because the anchor itself would fail. The third type of failure observed, was that the reinforcement strip would reach its maximum strength and would fail.

As defined herein, debonding means that as the load was being applied to the concrete block, the stresses in the bond between the carbon reinforcement strip and the concrete block exceeded the capacity of the bond. As defined herein, anchor pullout can be described by the anchor itself beginning to come out of the concrete block or splays of the anchors debonding from the concrete block. As defined herein, a concrete cone failure occurs when the anchor pulls out of the concrete with a cone of concrete still attached to the anchor. As defined herein, concrete shearing means that the load on the concrete block exceeded the capacity of the shear reinforcement placed in the concrete block. As defined herein, anchor debonding means that the anchor itself that is embedded into the concrete block debonded from the concrete block. As defined herein, reinforcement strip failure occurred when the stresses on the reinforcement strip exceed the strength of the reinforcement strip.

The three-point testing of the concrete blocks was modeled after ASTM C 293, the Standard Test Method for Flexural Strength of Concrete Using Simple Beam with Center-Point Loading. The concrete blocks were 24 inches long, 6 inches high and 8 inches wide. The object of the test was to design a beam and carbon reinforcement strip combination such that the tensile force in the beam would be great enough to break the reinforcement strip (or anchor, whichever comes first), but not have the concrete fail in shear until failure of the reinforcement strip. Fifteen (15) different samples were made for the test. Three samples only included a reinforcement strip bonded to the concrete block. These three samples were designated as the control samples. Three samples included a reinforcement strip and two Splay anchors. Three samples included a reinforcement strip and two Fyfe anchors. Three samples included a reinforcement strip and two anchors of the present invention wherein the slot was cut parallel to the longitudinal length of the reinforcement strip. Lastly, three samples included a reinforcement strip and two anchors of the present invention wherein the slot was cut perpendicular to the longitudinal length of the reinforcement strip. The reinforcement strip was 16 inches in length. The anchors were connected in holes or slots that were spaced 2 inches from each end of the reinforcement strip. The carbon fibers in the Splay was VU 180 carbon made by V2 Composites, Inc. It is believed that the commercially available Fyfe anchors were formed of the same or similar carbon fibers. The carbon fibers used for the fabric for the anchors of the present invention was VXV 150 made by V2 Composites, Inc. The resin used to secure the anchors in the holes or slots in the concrete blocks was a high strength, high modulus resin made by Prime Resins.

The Splay anchors were constructed in a manner similar to that disclosed in an article entitled *Experimental Behaviour of Carbon Fiber-Reinforced Polymer, CFRP . . . Sheets Attached to Concrete Surfaces Using CFRP Anchors* by Niemitz et al., which is incorporated herein by reference. A strip of carbon fiber material was cut and then rolled to the desired diameter. There are two types of anchors that are constructed this way, namely "Dry Fiber" and "Impregnated Fiber" anchors as disclosed in an article entitled *Behaviour of Handmade FRP Anchors under Tensile Load in Uncracked Concrete* by Kim et al., which is incorporated herein by reference. Impregnated anchors are made from rolled carbon fibers, and then at least half of the anchor is impregnated with resin and cured (Fyfe anchors). Dry Fiber anchors are made from rolled carbon fibers, but not impregnated (Splay anchors). The dry fiber anchors were made with a diameter of 0.5 inches, an embedment length of 2 inches, and a splay diameter of 2 inches. The Fyfe anchors were made from carbon roving. Unlike the Splay anchors, the Fyfe anchors were not cut out of a sheet of fabric and then rolled. The Fyfe anchors that were used are commercially designated as Tyfo SCH Fibr Anchor and are available from Fyfe.

The anchors of the present invention were made of two strips of carbon fabric and two strips of fiberglass fabric. The carbon and fiberglass fabric strips were cut to a 24-inch width. The carbon fabric strips were then cut to 8 inches in height and the glass fabric strips were cut to 3 inches in height. The bottom 3 inches of the carbon fabric strip and the entire 3 inch high fiberglass strip were impregnated with resin and then clamped together until the resin cured. Once the resin was cured, the bottom portion of the anchor that included the cured resin was cut to the proper width and a radius so that the bottom portion of the anchor could fit into the groove that was fainted in the concrete block. The groove in the concrete block was formed by a saw blade.

The concrete blocks that were to be tested with the Splay and Fyfe anchors, had holes that were drilled into the concrete blocks at a depth of 2 inches and the holes were spaced 12 inches apart. Each of the concrete blocks was treated with a layer of adhesive and then the layer of carbon reinforcement was wet laid onto the concrete block. For the Splay anchors, resin was poured into the holes and the dry top portion of the Splay anchor was fanned out. More resin was then applied with a roller to the splays of the Splay anchor and then left to cure. For the Fyfe anchors, resin was not used, but the same surface prepping bond was poured into the holes to create the bond between the anchor and the concrete. The dry top portion of the Fyfe anchor was fanned out. More resin was then applied with a roller to the splays of the Fyfe anchor and then left to cure.

For the concrete blocks that were to be tested with the anchors of the present invention, two saw cuts were made into the concrete block and the slots were spaced 10 inches apart. An adhesive was applied to the surface of the concrete. The anchors of the present invention were secured to the concrete block before placing the carbon reinforcement strip on the concrete block. The two saw cuts were filled with the same adhesive as was applied to the surface of the concrete block and the bottom portion of the anchors of the present invention were then inserted into the adhesive filled cut slots. Thereafter, resin was applied to the top portion of the anchors and then the strip of carbon reinforcement was installed on the concrete block. Two types of saw cuts were used, one type being parallel to the longitudinal length of the concrete block, and one type being perpendicular to the longitudinal length of the concrete block.

All of the concrete block samples were tested using a three-point bend method. The span was 21 inches wide and was simply supported at both ends. The load that was applied to the concrete blocks was 2500 lbs./min. Each test lasted approximately 4 minutes. In each sample, the tensile crack formed at or around 6000 lbs. The average compression strength of the concrete blocks on the day of testing was about 2700 psi. Table 1 illustrates the results obtained from the testing of the concrete blocks with the various types of anchors.

TABLE 1

| Anchor Type | Peak Load (lbs.) | Failure Mode |
|---|---|---|
| Control - No Anchor | 5799 | Debonding |
| | 5883 | Debonding |
| | 5145 | Debonding |
| Splay Anchor | 5879 | Anchor Pullout |
| | 7130 | Anchor Pullout |
| | 5231 | Anchor Pullout |
| Fyfe Anchor | 6213 | Anchor Pullout |
| | 5697 | Anchor Pullout |
| | 6394 | Anchor Pullout |
| New Anchor - Perpendicular Orientation | 9491 | Concrete Cone |
| | 9533 | Concrete Cone |
| | 7522 | Concrete Cone |
| New Anchor – Parallel Orientation | 10220 | Concrete Shear |
| | 9258 | Anchor Debonding |
| | 9513 | Strip Failure/Debonding |

From the data obtained, as set forth in Table 1, it is readily evident that significant increases in peak load on the concrete blocks was obtained by use of the new anchors in accordance with the present invention. The new anchors installed with a parallel orientation also showed a small increase over the new anchors installed with a perpendicular orientation. In all the samples, the concrete blocks cracked at an average of 6000 lbs. Since the point that the concrete blocks cracked was generally constant for all of the concrete blocks tested, it was assumed that the various types of anchors used had very little, if anything, to do with the initial concrete block failure. This initial concrete failure was expected because concrete cracking is almost entirely dependent on the concrete compressive strength.

Figure 16:
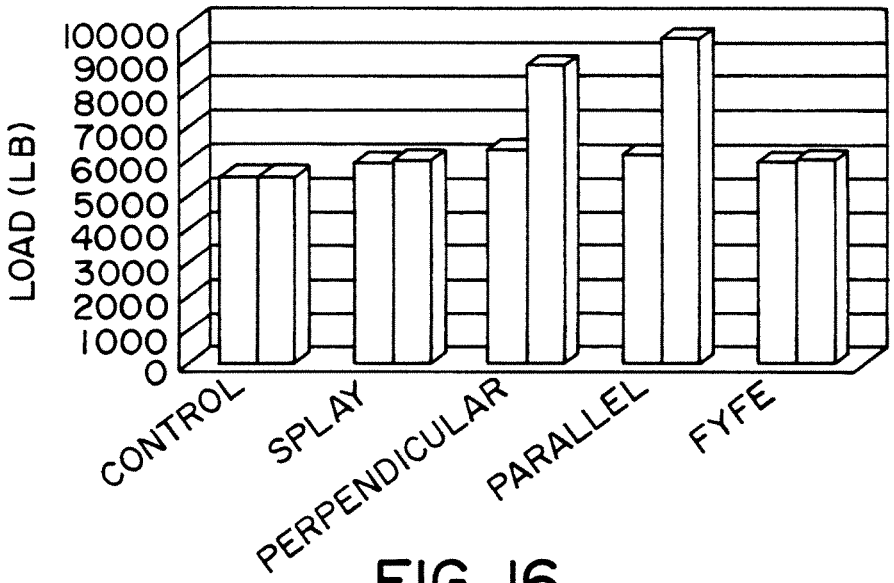

The tensile strength of a single carbon reinforcement strip that was impregnated with resin was 150-160 KSI. The stress built up in the carbon reinforcement strip was determined by using the maximum loads that were recorded during the testing process. This calculation was based on the premise that once the crack in the concrete block formed at about 6000 lbs. of load, the only structure that could further handle additional load forces was the carbon reinforcement strip and the two anchors. The bond between the carbon reinforcement strip and the concrete block is not nearly sufficient to hold the carbon reinforcement strip on the concrete block after the crack has formed in the concrete block. As mentioned above, once the concrete block cracks, the concrete block will attempt to further bend under the applied load, thus the peeling stresses on the carbon reinforcement strip dramatically increased after the crack is formed in the concrete block. As a result of these peeling stresses, the reinforcement strip essentially debonds from the concrete block shortly before or after the concrete block cracks. The normalized thickness of the carbon reinforcement strip was 0.03 inches. The carbon reinforcement strip was about 2 inches wide and had a cross-sectional area of 0.06 $in^2$. Using the cross-sectional area of the carbon reinforcement strip, a force per unit area was obtained for the carbon reinforcement strips. For example, one of the tests resulted in the carbon reinforcement strip failing at a load of 9513 lbs. When this load is divided by the cross-sectional area of the carbon reinforcement strip, the force per unit area of the carbon reinforcement strip is 158,550 psi. This number is in the range of the ultimate value given for a single layer of carbon impregnated with resin. As indicated in Table 1, only one sample actually reached its maximum tensile strength and started to fail. This sample used the anchor of the present invention and the cut slots were oriented in the parallel orientation relative to the longitudinal length of the reinforcement strip. Table 1 and FIG. 16 reveal that the new anchor of the present invention performed significantly better than the prior art Splay and Fyfe anchors in terms of increasing the load taken up by the reinforcement carbon strip. FIG. 16 illustrates two bar graphs for each of the samples. The first bar graph illustrates the load on the concrete block that a crack first appeared. As was evident from the control sample, the second bar graph is nearly identical from the first bar graph since the carbon reinforcement strip without use of anchors, rapidly debonded from the concrete block after the crack was formed, thus the carbon reinforcement strip was unable to take on additional loads after the crack was formed. The second bar for both the Splay and Fyfe anchors illustrates that the anchors and carbon reinforcement strip were able to take on some additional loads after a crack was formed in the concrete block. The second bar of the anchors of the present invention and the carbon reinforcement strip illustrates a dramatic increase in the amount of additional load that was taken on by the anchors of the present invention and the carbon reinforcement strip.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

I claim:

1. A method for reinforcing a load-bearing or load-transmitting structural component comprising:

providing a reinforcement strip;

providing an anchor, said anchor comprising first and second fabric layers, said anchor including a top and a bottom portion, said first and second fabric layers connected together at said bottom portion, said first fabric layer forming a first flap portion at said top portion of said anchor and said second fabric layer forming a second flap portion at said top portion of said anchor, at least a portion of said first and second fabric layers not connected together at said top portion of said anchor, said first and second fabric layers including a material selected from the group consisting of carbon fibers, aramid fibers and glass fibers, said top portion of said anchor is movable relative to said bottom portion, said bottom portion having a greater rigidity and less flexibility than said top portion;

forming a slot or hole in said structural component;

inserting said bottom portion of said anchor in said slot or hole, said first and second fabric layers are connected together at said bottom portion prior to said insertion into said slot or hole in said structural component;

adhesively securing said bottom portion in said slot or hole;

moving each of said first and second flap portions on or over an exterior surface of said structural component after said bottom portion of said anchor is inserted in said slot or hole, said step of moving each of said first and second flap portions including moving said first and second flap portions relative to said bottom portion of said anchor while said bottom portion of said anchor is rigidly positioned in said slot or hole;

adhesively securing said reinforcement strip to said exterior surface of said structural component; and, adhesively securing at least one of said first and second flap portions to said reinforcement strip after said bottom portion is adhesively secured in said slot or hole, said top portion of said anchor only engaging one or more surfaces of said reinforcement strip selected from the group consisting of a top surface of said reinforcement strip, and a bottom surface of reinforcement strip.

2. The method as defined in claim 1, wherein said anchor includes third and fourth fabric layers, said first, second, third, and fourth fabric layers connected together at said bottom portion, said first fabric layer connected to said third fabric layer at said top portion to form said first flap portion, said second layer connected to said fourth fabric layer at said top portion to form said second flap portion.

3. The method as defined in claim 2, wherein said first and second fabric layers include carbon fibers, said third and fourth fabric layers include glass fibers, said first and second fabric layers formed of at least one different material than contained in said third and fourth fabric layers.

4. The method as defined in claim 3, wherein said fabric layers are connected together at said bottom portion by a bottom portion adhesive that is partially or fully cured prior to inserting said bottom portion into said hole or slot of said structural component, said bottom portion adhesive having a different composition from an adhesive used to connect said top portion of said anchor to said reinforcement strip, said surface of said structural component, or combination thereof.

5. The method as defined in claim 4, wherein said hole or slot in said structural component has a depth, length and width, said length of said hole or slot greater than said width of said hole or slot.

6. The method as defined in claim 5, wherein said length of said hole or slot cut in a plane is parallel to, or perpendicular to a longitudinal axis of said reinforcement strip.

7. The method as defined in claim 6, wherein said reinforcement strip is connected to said top portion of said anchor such that a) a top surface of said reinforcement strip is connected to one or both of said first and second flap portions, b) a bottom surface of said reinforcement strip is connected to one or both of said first and second flap portions, or c) both a) and b).

8. The method as defined in claim 7, wherein said reinforcement strip is connected to said top portion of said anchor by an arrangement selected from the group consisting of a) both said first and second flap portions are connected to said reinforcement strip such that said first flap portion is connected to said top surface of said reinforcement strip and said second flap portion is connected to said bottom surface of reinforcement strip, b) both said first and second flap portions are connected to said bottom surface of said reinforcement strip, c) only one of said first flap portion or said second flap portion is connected to said reinforcement strip.

9. The method as defined in claim 1, wherein said anchor has a longitudinal length, width and thickness, said width of said anchor greater than said thickness of said anchor, said longitudinal length of said anchor greater than said thickness of said anchor, a longitudinal length of said top portion greater than a longitudinal length of said bottom portion.

10. The method as defined in claim 1, wherein said fabric layers are connected together at said bottom portion by a bottom portion adhesive that is partially or fully cured prior to inserting said bottom portion into said hole or slot of said structural component, said bottom portion adhesive having a different composition from an adhesive used to connect said top portion of said anchor to said reinforcement strip, said surface of said structural component, or combinations thereof.

11. The method as defined in claim 1, wherein said hole or slot in said structural component has a depth, length and width, said length of said hole or slot greater than said width of said hole or slot.

12. The method as defined in claim 11, wherein said length of said hole or slot cut in a plane is parallel to, or perpendicular to a longitudinal axis of said reinforcement strip.

13. The method as defined in claim 1, wherein said reinforcement strip is connected to said top portion of said anchor such that a) a top surface of said reindforced strip is connected to one or both of said first and second flap portions, b) a bottom surface of said reinforcement strip is connected to one or both of said first and second flap portions, or c) both a) and b).

14. The method as defined in claim 1, wherein said reinforcement strip is connected to said top portion of said anchor by an arrangement selected from the group consisting of a) both said first and second flap portions are connected to said reinforcement strip such that said first flap portion is connected to said top surface of said reinforcement strip and said second flap portion is connected to said bottom surface of reinforcement strip, b) both said first and second flap portions are connected to said bottom surface of said reinforcement strip, c) only one of said first flap portion or said second flap portion is connected to said reinforcement strip.

15. A method for reinforcing a load-bearing or load-transmitting structural component comprising:

providing a flexible reinforcement strip, said reinforcement strip includes at least one fiber layer, said at least one fiber layer including one or more fibers selected from the group consisting of carbon fibers, glass fibers, aramid fibers, boron fibers, hemp fibers and basalt fibers;

providing an anchor, said anchor comprising first, second, third and fourth fabric layers, said first, second, third and fourth layers including a material selected from the group consisting of carbon fibers, aramid fibers and glass fibers, said anchor including a top and a bottom portion, said first, second, third and fourth connected together at said bottom portion, said first and third fabric layers forming a first flap portion at said top portion of said anchor and said second and fourth fabric layers forming a second flap portion at said top portion of said anchor, at least a portion of said first and second flap portions not connected together at said top portion of said anchor fibers, said top portion of said anchor is movable relative to said bottom portion, said bottom portion having a greater rigidity and less flexibility than said top portion;

forming a slot or hole in said structural component;

inserting said bottom portion of said anchor in said slot or hole;

adhesively securing said bottom portion in said slot or hole;

moving at least one of said first and second flap portions on or over an exterior surface of said structural component after said bottom portion of said anchor is inserted in said slot or hole, said step of moving at least one of said first and second flap portions including moving at least one of said first and second flap portions relative to said bottom portion of said anchor while said bottom portion of said anchor is positioned in said slot or hole;

adhesively securing said reinforcement strip to said exterior surface of said structural component; and, adhesively securing at least a portion of said top portion of said anchor to said reinforcement strip after said bottom portion is adhesively secured in said slot or hole, a ratio of a width of said reinforcement strip to a width of said top portion of said anchor is about 0.25-4:1, a thickness ratio of said reinforcement strip to said anchor is about 0.1-2:1, said reinforcement strip is connected to said top portion of said anchor by an arrangement selected from the group consisting of a) both said first and second flap portions are connected to said reinforcement strip such that said first flap portion is connected to a top surface of said reinforcement strip and said second flap portion is connected to a bottom surface of reinforcement strip, b) both said first and second flap portions are connected to said bottom surface of said reinforcement strip, c) only one of said first flap portion or said second flap portion is connected to said reinforcement strip.

16. The method as defined in claim 15, wherein said first and third fabric layers include different materials, said first fabric layer including carbon containing fibers, said third fabric layer including glass containing fibers, wherein said second and fourth fabric layers included different materials, said second fabric layer including carbon containing fibers, said fourth fabric layer including glass containing fibers.

17. The method as defined in claim 16, wherein said first and third fabric layers are adhesively bonded together prior to said step of positioning said bottom portion of said anchor in said slot or hole, said second and fourth fabric layers are adhesively bonded together prior to said step of positioning said bottom portion of said anchor in said slot or hole.

18. The method as defined in claim 15, wherein said first and third fabric layers are adhesively bonded together prior to said step of positioning said bottom portion of said anchor in said slot or hole, said second and fourth fabric layers are adhesively bonded together prior to said step of positioning said bottom portion of said anchor in said slot or hole.

19. A method for reinforcing a load-bearing or load-transmitting structural component comprising:

providing a reinforcement strip, said reinforcement strip includes at least one fiber layer;

providing first and second anchors, each of said anchors comprising first and second fabric layers, each of said anchors including a top and a bottom portion, said first and second fabric layers of each of said anchors connected together at said bottom portion, said first fabric layer of each of said anchors forming a first flap portion at said top portion of each of said anchors and said second fabric layer of each of said anchors forming a second flap portion at said top portion of each of said anchors, at least a portion of said first and second fabric layers of each of said anchors not connected together at said top portion of each of said anchors, said top portion of each of said anchors is movable relative to said bottom portion, said bottom portion of each of said anchors having a greater rigidity and less flexibility than said top portion;

forming first and second slots or holes in said structural component;

inserting said bottom portion of said first anchor in said first slot or hole and inserting said bottom portion of said second anchor in said second slot or hole;

adhesively securing said bottom portion of said first anchor in said first slot or hole and adhesively securing said bottom portion of said second anchor in said second slot or hole;

moving at least one of said first and second flap portions of said first anchor on or over an exterior surface of said structural component after said bottom portion of said first anchor is inserted in said first slot or hole, said step of moving at least one of said first and second flap portions including moving at least one of said first and second flap portions relative to said bottom portion of said first anchor while said bottom portion of said first anchor is positioned in said first slot or hole;

moving at least one of said first and second flap portions of said second anchor on or over an exterior surface of said structural component after said bottom portion of said second anchor is inserted in said second slot or hole, said step of moving at least one of said first and second flap portions including moving at least one of said first and second flap portions relative to said bottom portion of said second anchor while said bottom portion of said second anchor is positioned in said second slot or hole;

adhesively securing said reinforcement strip to said exterior surface of said structural component; and, adhesively securing at least a portion of said top portion of said first and second anchors to said reinforcement strip.

20. The method as defined in claim 19, wherein said reinforcement strip is connected to said top portion of said first and second anchors by an arrangement selected from the group consisting of a) both said first and second flap portions are connected to said reinforcement strip such that said first flap portion is connect to a top surface of said reinforcement strip and said second flap portion is connected to a bottom surface of reinforcement strip, b) both said first and second flap portions are connected to said bottom surface of said reinforcement strip, c) only on of said first flap portion or said second flap portion is connected to said reinforcement strip.

21. The method as defined in claim 19, wherein said first and second fabric layers of each of said anchors include a material selected from the group consisting of carbon fibers, aramid fibers and glass fibers.

22. The method as defined in claim 19, wherein each of said anchors include third and fourth fabric layers, said first, second, third, and fourth fabric layers connected together at said bottom portion, said first fabric layer connected to said third fabric layer at said top portion to form said first flap portion, said second layer connected to said fourth fabric layer at said top portion to form said second flap portion.

23. The method as defined in claim 22, wherein said first and third fabric layers of said anchors include different materials, said second and fourth fabric layers include different materials.

24. The method as defined in claim 19, wherein said fabric layers that form the bottom portion of each of said anchors are adhesively bonded together prior to said step of positioning said bottom portion of each said anchor in said respective slot or hole.

25. The method as defined in claim 19, wherein said each of said anchors has a longitudinal length, width and thickness, said width of each of said anchors is greater than said thickness of each of said anchors, said longitudinal length of each of said anchors is greater than said thickness of each of said anchors, a longitudinal length of said top portion of each of said anchors is greater than a longitudinal length of said bottom portion of each of said anchors.

26. The method as defined in claim 19, wherein said fabric layers of each of said anchors are connected together at said bottom portion by a bottom portion adhesive that is partially or fully cured prior to inserting said bottom portion of each of said anchors into said respective hole or slot of said structural component, said bottom portion adhesive having a different composition from an adhesive used to connect said top portion of each of said anchors to said reinforcement strip, said surface of said structural component, or combinations thereof.

* * * * *